US008163457B2

(12) United States Patent
Yamazaki et al.

(10) Patent No.: US 8,163,457 B2
(45) Date of Patent: Apr. 24, 2012

(54) PROCESS FOR PREPARING TONER FOR ELECTROPHOTOGRAPHY

(75) Inventors: Masahito Yamazaki, Wakayama (JP); Satoshi Kunii, Wakayama (JP)

(73) Assignee: Kao Corporation, Tokyo (JP)

( * ) Notice: Subject to any disclaimer, the term of this patent is extended or adjusted under 35 U.S.C. 154(b) by 1001 days.

(21) Appl. No.: 12/107,441

(22) Filed: Apr. 22, 2008

(65) Prior Publication Data

US 2008/0268365 A1 Oct. 30, 2008

(30) Foreign Application Priority Data

Apr. 26, 2007 (JP) ..... 2007-117616
Aug. 9, 2007 (JP) ..... 2007-207994
Oct. 9, 2007 (JP) ..... 2007-263440

(51) Int. Cl.
*G03G 5/00* (2006.01)

(52) U.S. Cl. ..... 430/137.1; 430/109.4

(58) Field of Classification Search ..... 430/137.1, 430/109.4

See application file for complete search history.

(56) References Cited

U.S. PATENT DOCUMENTS 6,326,115 B1 12/2001 Nakanishi et al.
6,764,798 B2 7/2004 Yamazaki et al.
6,861,190 B2 3/2005 Yamazaki et al.
6,919,156 B2 7/2005 Kameyama et al.
7,235,337 B2 6/2007 Kameyama et al.
2001/0018157 A1 8/2001 Aoki et al.
2003/0203302 A1 10/2003 Kanamaru et al.
2006/0088780 A1* 4/2006 Kadota ..... 430/108.6
2006/0121386 A1* 6/2006 Kamikoriyama et al. ..... 430/111.35
2006/0216626 A1 9/2006 Sacripante et al.
2007/0207401 A1 9/2007 Shirai
2008/0107987 A1 5/2008 Fukushima et al.

FOREIGN PATENT DOCUMENTS

JP 08-020636 1/1996
JP 10-048871 2/1998
JP 10-239903 9/1998
JP 11-133668 5/1999
JP 2001-222138 8/2001
JP 2005-308995 11/2005
JP 2006-065015 3/2006
JP 2006-065077 3/2006
JP 2006-071906 3/2006
JP 2006-276855 10/2006

OTHER PUBLICATIONS

U.S. Appl. No. 12/559,064, filed Sep. 14, 2009, Kunii, et al.
U.S. Appl. No. 12/053,817, filed Mar. 24, 2008, Kunii, et al.

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A process for preparing a toner for electrophotography containing mother toner particles which contain a resin binder containing a crystalline polyester and a linear amorphous polyester and an external additive, wherein the process includes an external addition step of mixing the mother toner particles and at least a part of the external additive and the step of carrying out a heat-treating step at the external addition step or later. The toner for electrophotography obtained according to the present invention is suitably used for, for example, developing a latent image formed in electrophotography, electrostatic recording method, electrostatic printing method, or the like.

20 Claims, 3 Drawing Sheets

PROCESS FOR PREPARING TONER FOR ELECTROPHOTOGRAPHY

FIELD OF THE INVENTION

The present invention relates to a toner for electrophotography used for, for example, developing a latent image formed in electrophotography, electrostatic recording method, electrostatic printing method, or the like, and a process for preparing the toner; and a method of forming fixed images using the toner.

BACKGROUND OF THE INVENTION

In recent years, a toner fixable at even lower temperature has been desired from the viewpoint of speeding up and miniaturization of an apparatus, and various toners in which an amorphous polyester and a crystalline polyester are used together have been studied (see JP2001-222138 A).

However, while the crystalline polyester is effective in low-temperature fixing ability, storage property is likely to be lowered. Therefore, in the manufacturing process of the toner, there has been suggested a process including carrying out a step of heat-treating a manufacturing intermediate such as a melt-kneaded product and a classified product (see JP2005-308995 A, JP2006-65015 A, JP2006-276855 A, and JP2006-65077 A).

On the other hand, a method of controlling shapes of the toner particles includes a method of finely-pulverizing toner particles using a mechanical impact apparatus for fine pulverization and a method of finely-pulverizing the toner particles by adjusting the pulverizing pressure to lower than usual and increasing the number of circulation in a jet type pulverization. In addition, there have been known a hot-water bath method including the steps of dispersing finely-pulverized toner particles or further classified toner particles into water and heating the dispersed toner particles, a heat-treating method including the step of allowing the toner particles to pass through hot air stream, a mechanical impact method including the step of treating the toner particles by giving a mechanical energy, and the like (see JP-A-Hei-10-48871).

SUMMARY OF THE INVENTION

The present invention relates to:

[1] a process for preparing a toner for electrophotography containing mother toner particles which contain a resin binder containing a crystalline polyester and a linear amorphous polyester and an external additive, wherein the process includes an external addition step of mixing the mother toner particles and at least a part of the external additive and the step of carrying out a heat-treating step at the external addition step or later;

[2] a toner obtained by the process as defined in the above [1];

[3] a method of forming fixed images, including the step of applying the toner as defined in the above [2] to an image-forming apparatus having a linear speed of 750 mm/sec or more; and

[4] a toner for electrophotography containing mother toner particles containing a resin binder and a wax and an external additive, wherein the resin binder contains a crystalline polyester, a calorie of an area surrounded by an endothermic curve of the toner determined with a differential scanning calorimeter and a straight line connecting the top of an endothermic peak appearing at the lowest temperature of endothermic peaks derived from the resin binder to the top of an endothermic peak derived from the wax having the lowest melting point of the waxes is from 0.1 to 10.0 J/g, and the toner has an average circularity of from 0.940 to 0.980 and contains particles having a particle size of less than 3 μm in an amount of 5% by number or less.

Figure 1:
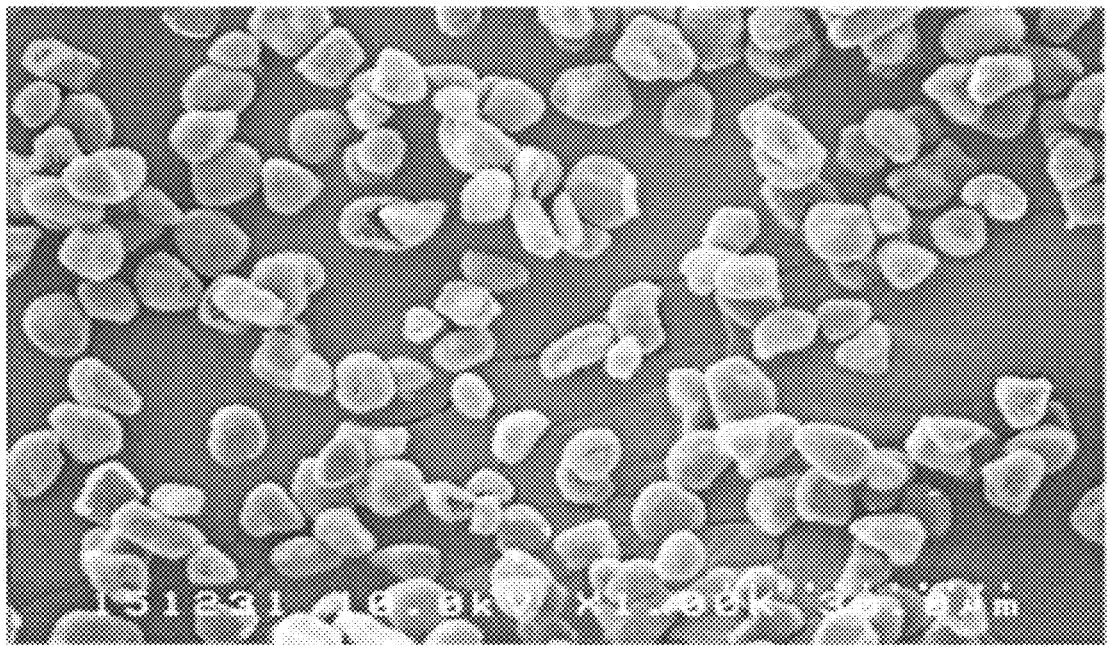
FIG. 1 is a photograph of the toners after the heat-treating step in Example 1-2, taken with a scanning electron microscope (magnification of 1000 times).
Figure 2:
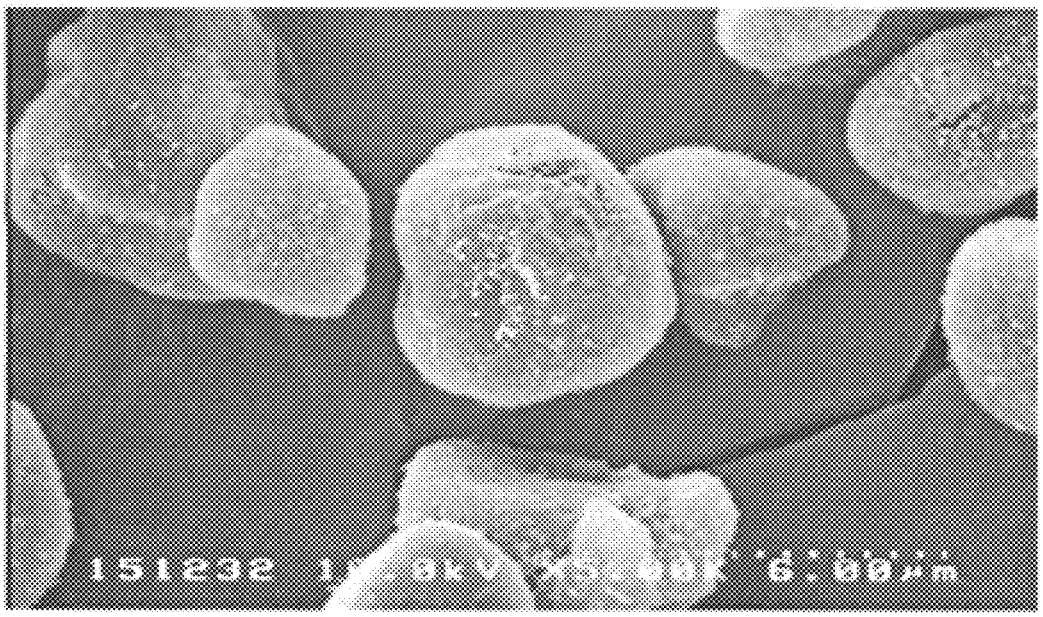
FIG. 2 is a photograph of the toners after the heat-treating step in Example 1-2, taken with a scanning electron microscope (magnification of 2000 times).
Figure 3:
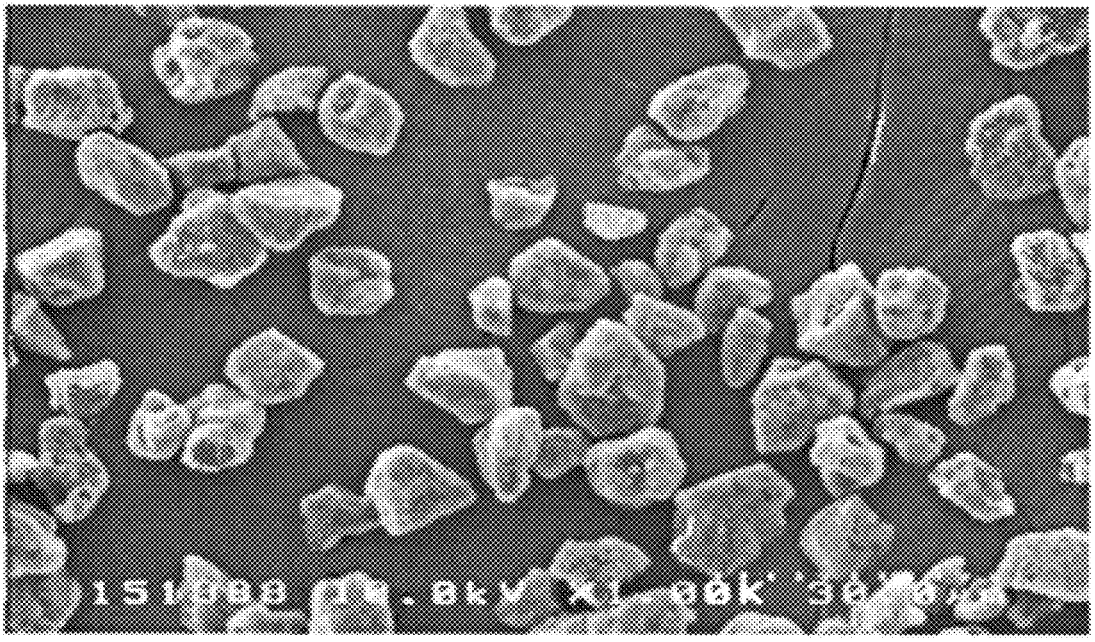
FIG. 3 is a photograph of the toners after the heat-treating step in Comparative Example 1-3, taken with a scanning electron microscope (magnification of 1000 times).
Figure 4:
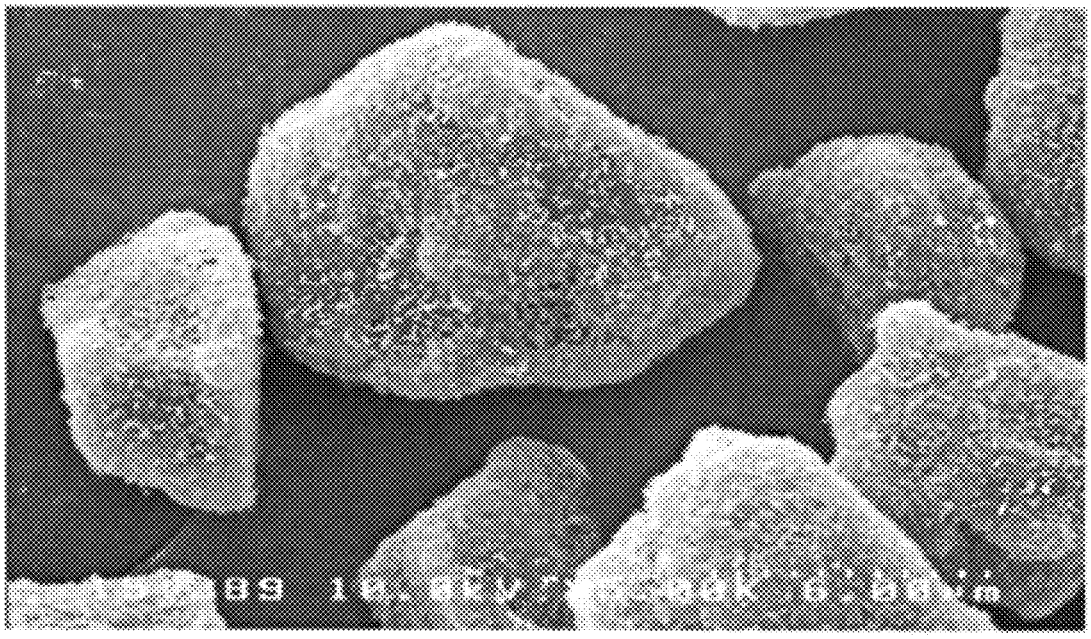
FIG. 4 is a photograph of the toners after the heat-treating step in Comparative Example 1-3, taken with a scanning electron microscope (magnification of 2000 times).

The explanation of the numerical symbols is as follows;

A is the top of an endothermic peak derived from the resin binder, B is the top of an endothermic peak derived from the wax, and C is an area surrounded by an endothermic curve and the above A and B.

DETAILED DESCRIPTION OF THE INVENTION

A conventional toner including a toner containing a crystalline polyester is insufficient in durability and likely to cause a problem such as filming especially in high-speed machines. Alternatively, when a long-term durability printing of fixed images at a low printing ratio is carried out, fine powders are generated in the machine and fluidity is worsened, and deterioration of the fixed images is caused.

Further, the conventional toner including a toner containing a crystalline polyester is effective in improvement in low-temperature fixing ability. However, the conventional toner is compatible with an amorphous polyester when the raw materials of the toner are melt-kneaded, whereby a crystalline structure of the crystalline polyester collapses, so that storage property and durability are consequently lowered.

In addition, even though the heat treatment is carried out as in the above-mentioned conventional techniques, it is difficult to obtain a stable fixed image in consequence of fine powders generated according to long term duration, and also, when crystallization is insufficient, a sufficient durability cannot be obtained. Especially, lowering of transferring ratio in durability printing at a low printing ratio is remarkable.

In addition, when a low-melting point wax is used for the purpose of improvement in fixing ability, durability is a further disadvantage.

The present invention relates to a toner for electrophotography, which is excellent in both low-temperature fixing ability and storage property, and also excellent in durability, and a process for preparing the toner; and a method of forming fixed images using the toner. Further, the present invention relates to a toner for electrophotography, which is excellent in both low-temperature fixing ability and storage property, and also excellent in durability, and can maintain excellent transfer efficiency and image density even in durability printing at a low printing ratio.

According to a process of the present invention, a toner for electrophotography, which is excellent in both low-temperature fixing ability and storage property, also excellent in durability, and exhibits stable properties even at a different printing ratio, can be prepared. In addition, in a further embodiment of the present invention, the toner for electrophotography of the present invention is excellent in both low-temperature fixing ability and storage property, and also excellent in durability, and can maintain excellent transfer efficiency and image density even in durability printing at a low printing ratio.

These and other advantages of the present invention will be apparent from the following description.

In the present invention, when the toner for electrophotography is prepared using a crystalline polyester as a resin binder, the process includes a heat-treating step, whereby low-temperature fixing ability, storage property and durability of the toner can be improved.

The first embodiment of the present invention is a process for preparing a toner for electrophotography containing mother toner particles which contain a resin binder containing a crystalline polyester, and an external additive, wherein the process includes an external addition step of mixing the mother toner particles and at least a part of the external additive and the step of carrying out a heat-treating step at the external addition step or later.

In the first embodiment, when a toner for electrophotography containing mother toner particles containing a resin binder, and an external additive is prepared through an external addition step including mixing the mother toner particles and at least a part of the external additive, a heat-treating step is carried out at the external addition step or later, whereby storage property is improved while an excellent fixing ability is maintained, and durability is improved as well. Although not wanting to be limited by theory, the reasons therefor are presumably as follows. A crystalline structure of crystalline polyester that has been collapsed by compatibleness with an amorphous polyester in a melt-kneading step is recrystallized according to the heat-treating step, whereby the toner particles are conglobated, and at the same time, the external additive which is more likely to electrostatically aggregate loosens during the heat-treating step and homogeneously adheres to the toner surface.

In the process of the first embodiment, the resin binder contains at least a crystalline polyester, and further contains preferably an amorphous polyester from the view point of storage property. The term "crystalline polyester" as used herein refers to a polyester having an index of crystallinity of from 0.6 to 1.5, and preferably from 0.8 to 1.2. In addition, the term "amorphous polyester" as used herein refers to a polyester having an index of crystallinity of more than 1.5 or less than 0.6, and preferably more than 1.5. The term "index of crystallinity" as used herein refers to a physical property showing an index of an extent of the crystallinity of the resin, which is defined by a ratio of the softening point to the highest temperature of endothermic peak determined by a differential scanning calorimeter, i.e. softening point/highest temperature of endothermic peak. Generally, when the index of crystallinity exceeds 1.5, the resin is amorphous, and when the index of crystallinity is less than 0.6, the resin is low in the crystallinity, and much of the portions are amorphous. The extent of the crystallization can be adjusted by the kinds of the raw material monomers and a ratio thereof, preparation conditions (for example, reaction temperature, reaction time, cooling rate), and the like. Here, the term "highest temperature of endothermic peak" refers to a temperature of the peak on the side of the highest temperature of the endothermic peak observed. When the difference between the highest temperature of endothermic peak and the softening point is 20° C. or less, the peak temperature is defined as a melting point, and when the difference between the highest temperature of endothermic peak and the softening point exceeds 20° C., the peak temperature is ascribed to a glass transition.

The crystalline polyester and the amorphous polyester both use an alcohol component and a carboxylic acid component as the raw material monomers, and are obtained by the polycondensation thereof.

It is preferable that the alcohol component in the crystalline polyester contains a monomer which enhances crystallinity of a resin, such as an aliphatic diol having 2 to 8 carbon atoms.

The aliphatic diol having 2 to 8 carbon atoms includes ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, 1,4-butenediol, and the like, and an α,ω-linear alkanediol is especially preferable. These aliphatic diols may be contained alone or in admixture of two or more kinds.

The aliphatic diol having 2 to 8 carbon atoms is contained in an amount of preferably 80% by mol or more, more preferably from 85% by mol, and even more preferably from 90% by mol, of the alcohol component, from the viewpoint of the high crystallinity. Further, when two or more kinds of the aliphatic diols having 2 to 8 carbon atoms are used, it is desired that one kind of the aliphatic diols constitutes 70% by mol or more, and preferably from 80 to 95% by mol, of the alcohol component. Among them, 1,4-butanediol and 1,6-hexanediol are preferable, and 1,6-hexanediol is more preferable. It is desired that these aliphatic diols are contained in an amount of preferably 70% by mol or more, and more preferably from 80% by mol or more, of the alcohol component.

It is preferable that the alcohol component in the amorphous polyester contains a monomer which enhances amorphousness of a resin, such as an aromatic diol such as an alkylene oxide adduct of bisphenol A represented by the formula (I):

(I)

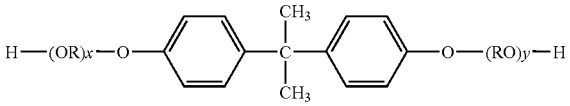

wherein RO is an alkyleneoxy group; R is an alkylene group having 2 or 3 carbon atoms; x and y are positive numbers showing an average number of moles of alkylene oxide added, wherein a sum of x and y is from 1 to 16, and preferably from 1.5 to 5, such as polyoxypropylene-2,2-bis(4-hydroxyphenyl)propane and polyoxyethylene-2,2-bis(4-hydroxyphenyl)propane.

The alkylene oxide adduct of bisphenol A represented by the formula (I) is contained in an amount of preferably 50% by mol or more, more preferably 70% by mol or more, and even more preferably 90% by mol or more, of the alcohol component, from the viewpoint of triboelectric chargeability.

The carboxylic acid compound contained in the carboxylic acid component includes aliphatic dicarboxylic acids having 2 to 30 carbon atoms and preferably 2 to 8 carbon atoms, such as adipic acid, oxalic acid, malonic acid, maleic acid, fumaric acid, citraconic acid, itaconic acid, glutaconic acid, succinic acid, sebacic acid, azelaic acid, n-dodecylsuccinic acid, and n-dodecenylsuccinic acid; aromatic dicarboxylic acids such as phthalic acid, isophthalic acid, and terephthalic acid; alicyclic dicarboxylic acids such as cyclohexanedicarboxylic acid; tricarboxylic or higher polycarboxylic acids such as trimellitic acid and pyromellitic acid; acid anhydrides thereof, alkyl(1 to 3 carbon atoms) esters thereof; and the like. Among them, the aliphatic dicarboxylic acid compounds are preferable. In the crystalline polyester, the aliphatic dicarboxylic acids having 2 to 8 carbon atoms are more preferable from the viewpoint of the crystallinity. In the amorphous polyester, fumaric acid is more preferable from the viewpoint of dispersibility of the crystalline polyester.

The aliphatic dicarboxylic acid compound is contained in an amount of preferably 70% by mol or more, more preferably from 80 to 100% by mol, and even more preferably from 90 to 100% by mol, of the carboxylic acid component.

In the present invention, it is preferable that the amorphous polyester is a linear amorphous polyester. In contrast to a common knowledge of one skilled in the art that a linear polyester is poor in durability as compared to a cross-linked polyester, an unexpected effect that durability can be improved even using a linear polyester is exhibited, according to the process of the present invention, including carrying out a heat-treating step. Here, the term "linear polyester" refers to a polyester obtained by polycondensing an alcohol component and a carboxylic acid component, wherein a dicarboxylic acid compound is contained in an amount of 80% by mol or more of the carboxylic acid component, a trihydric or higher polyhydric alcohol is not contained or is contained in an amount of less than 0.05% by mol of the alcohol component, and a tricarboxylic or higher polycarboxylic acid is not contained or is contained in an amount of less than 20% by mol of the carboxylic acid component.

Here, the molar ratio of the carboxylic acid component to the alcohol component, i.e., carboxylic acid component/alcohol component, in the crystalline polyester is preferably such that the proportion of the alcohol component is larger than that of the carboxylic acid component, to form a high-molecular crystalline polyester. Further, the molar ratio is preferably from 0.9 to 1, and more preferably from 0.95 to 1, from the viewpoint of easily adjusting the molecular weight of the polyester by distilling off the alcohol component during the reaction under reduced pressure.

In addition, the alcohol component may properly contain a monohydric alcohol, and the carboxylic acid component may properly contain a monocarboxylic acid compound, from the viewpoint of adjusting the molecular weight and the like.

The polyester is obtained by polycondensing the alcohol component and the carboxylic acid component, for example, in an inert gas atmosphere, in the presence of an esterification catalyst as desired. The reaction temperature is preferably from 120° to 230° C. in the preparation of the crystalline polyester, and is preferably from 180° to 250° C. in the preparation of the amorphous polyester.

In the preparation of the crystalline polyester, an entire monomer may be charged at once in order to enhance the strength of the resin, or divalent monomers may be firstly reacted, and thereafter trivalent or higher polyvalent monomers are added thereto and reacted in order to reduce the low-molecular weight components. In addition, the reaction may be accelerated by subjecting the reaction system to polymerization under a reduced pressure in a second half of the polymerization.

In addition, in order to obtain an even higher-molecular crystalline polyester, the molar ratio of the carboxylic acid component to the alcohol component may be adjusted as mentioned above, and reaction conditions such as elevation of the reaction temperature, increase in the amount of the catalyst, and performance of a dehydration reaction for a long period of time under reduced pressure may be selected. Incidentally, a high-molecular, high-viscosity crystalline polyester can be also produced under high-agitation required power. However, when the crystalline polyester is produced without particularly selecting production equipment, a process including the steps of reacting raw material monomers together with a non-reactive low-viscosity resin and a solvent is also an effective means.

The crystalline polyester has a softening point of preferably from 70° to 140° C., more preferably from 80° to 130° C., and even more preferably from 105° to 130° C., from the viewpoint of low-temperature fixing ability.

The crystalline polyester has a melting point of preferably from 60° to 140° C., more preferably from 70° to 130° C., and even more preferably from 80° to 120° C., from the viewpoint of fixing ability.

The amorphous polyester has a softening point of preferably from 80° to 150° C., more preferably from 85° to 145° C., and even more preferably from 90° to 145° C.

The amorphous polyester has an acid value of preferably from 1 to 50 mgKOH/g, and more preferably from 10 to 30 mgKOH/g. Also, the amorphous polyester has a glass transition temperature of preferably from 40° to 80° C., and more preferably from 50° to 70° C., from the viewpoint of pulverizability and storage property.

It is preferable that the crystalline polyester and the amorphous polyester are obtained by using at least one common compound as the raw material monomer, from the viewpoint of dispersibility of the crystalline polyester. As the common compound, the carboxylic acid component is preferable, and from the viewpoint of increasing the crystallinity of the crystalline polyester, fumaric acid and phthalic acid are more preferable, and fumaric acid is even more preferable.

The crystalline polyester is contained in an amount of preferably from 2 to 35% by weight, more preferably from 3 to 30% by weight, and even more preferably from 5 to 25% by weight, of the resin binder, from the viewpoint of improvement in durability.

Also, the amorphous polyester is contained in an amount of preferably from 50 to 95% by weight, more preferably from 60 to 95% by weight, and even more preferably from 70 to 90% by weight, of the resin binder, from the viewpoint of fixing ability, storage property, conglobation, and productivity.

In addition, when the resin binder contains the amorphous polyester, a weight ratio of the crystalline polyester to the amorphous polyester, i.e., crystalline polyester/amorphous polyester, is preferably from 3/97 to 35/65, and more preferably 5/95 to 30/70, from the viewpoint of improvements in low-temperature fixing ability and durability.

Incidentally, in the present invention, the polyester may be a polyester that has been modified to an extent that the polyester do not substantially impair the properties. A modified polyester includes a polyester that has been grafted or blocked with phenol, urethane, epoxy, or the like according to the method described in JP-A-Hei-11-133668, JP-A-Hei-10-239903, JP-A-Hei-8-20636, or the like, and a composite resin having two or more kinds of resin units including a polyester unit.

In the first embodiment, besides the crystalline polyester and the amorphous polyester, other resin binders may be properly used within the range which would not impair the effects of the present invention. Other resin binders include resin binders other than polyester, such as vinyl resins, epoxy resins, polycarbonates, and polyurethanes, and the like. The crystalline polyester and the amorphous polyester are contained in a total amount of preferably 80% by weight or more, and more preferably 90% by weight or more, of the resin binder, from the viewpoint of low-temperature fixing ability, but not particularly limited thereto.

The toner of the first embodiment may further properly contain an additive such as a colorant, a releasing agent, a charge control agent, a magnetic powder, a fluidity improver, an electric conductivity modifier, an extender, a reinforcing filler such as a fibrous substance, an antioxidant, an anti-aging agent, or a cleanability improver.

As the colorant, all of the dyes, pigments, and the like, which are used as colorants for a toner can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, Isoindoline, Disazoyellow, and the like can be used. The toner of the present invention may be either black toners or color toners. The colorant is contained in an amount of preferably from 1 to 40 parts by weight, and more preferably from 2 to 10 parts by weight, based on 100 parts by weight of the resin binder.

It is preferable that the mother toner particles are prepared through a melt-kneading step including melt-kneading the raw materials such as the resin binder containing at least the crystalline polyester and the colorant properly used, a pulverization step including pulverizing the melt-kneaded product, and a classifying step including classifying the pulverized product. It is preferable that the raw materials such as the crystalline polyester and the colorant, to be subjected to the melt-kneading step, are mixed with a Henschel mixer or the like, and the mixture is thereafter subjected to the melt-kneading step.

The melt-kneading of the raw materials can be carried out using a known kneader such as a closed type kneader, a single-screw or twin-screw extruder, or an open-roller type kneader, and it is preferable to use a twin-screw extruder. The temperature of the melt-kneading is not particularly limited as long as each of the raw materials is sufficiently miscible with each other.

The pulverization step is a step including pulverizing the resulting melt-kneaded product to a volume-median particle size of preferably 20 μm or less and more preferably 10 μm or less, from the viewpoint of improvement in durability.

The pulverization step may be carried out in divided multi-stages. For example, the melt-kneaded product may be roughly pulverized to a size of from 1 to 5 mm or so and thereafter further finely pulverized. In addition, in order to improve productivity during the pulverization and classifying steps, the melt-kneaded product may be mixed with fine inorganic particles such as hydrophobic silica and thereafter pulverized.

The pulverizer used in the pulverization step is not particularly limited. For example, the pulverizer used preferably in the rough pulverization includes an atomizer, Rotoplex, and the like, and the pulverizer used preferably in the fine pulverization includes a jet mill, an impact type mill, a rotary mechanical mill, and the like.

The classifier used in the classifying step includes an air classifier, a rotor type classifier, a sieve classifier, and the like. During the classifying step, the pulverized product which is insufficiently pulverized and removed may be subjected to the pulverization step again.

After the melt-kneading step, an external addition step including mixing the mother toner particles obtained through the pulverization step and the classifying step and at least a part of the external additive is carried out, to externally add the external additive to the toner surface. The mother toner particles have a volume-median particle size ($D_{50}$) of preferably from 4 to 12 μm, and more preferably from 5 to 10 μm. The term "volume-median particle size ($D_{50}$)" as used herein refers to a particle size of which cumulative volume frequency calculated on a volume percentage is 50% counted from the smaller particle sizes.

The external additive includes fine inorganic particles made of silica, alumina, titania, zirconia, tin oxide, zinc oxide or the like. Among them, silica having a small specific gravity is preferable from the viewpoint of prevention of embedment.

The silica is preferably a hydrophobic silica which has been hydrophobically treated, from the viewpoint of environmental stability. The method of hydrophobic treatment of the silica is not particularly limited. The hydrophobic treatment agent includes hexamethyldisilazane (HMDS), dimethyldichlorosilane, silicone oil, methyltriethoxysilane, and the like. Among them, hexamethyldisilazane is preferable. The amount of the hydrophobic treatment agent is preferably from 1 to 7 mg/m$^2$ per surface area of the silica.

The external addition step is carried out before the heat-treating step set forth below, and besides, the external addition step may be further carried out after the heat-treating step. It is preferable that a silica having an average particle size of preferably from 12 to 120 nm, more preferably from 35 to 80 nm, and even more preferably from 40 to 60 nm (silica A) is used as an external additive used in the external addition step before the heat-treating step, from the viewpoint of prevention of embedment into the toner and prevention of free silica at the heat-treating step. It is more preferable that a silica having an average particle size smaller than that of the silica A (silica B) is used together with the silica A, from the viewpoint of giving fluidity.

The silica A is externally added to the mother toner particles in an amount of preferably 0.3 parts by weight or more, more preferably from 0.3 to 5.0 parts by weight, and even more preferably 0.5 to 2.0 parts by weight, based on 100 parts by weight of the mother toner particles, from the viewpoint of prevention of aggregation during the heat treatment.

The silica B has an average particle size of preferably from 10 to 30 nm, and more preferably from 10 to 20 nm, from the viewpoint of giving fluidity.

In addition, the average particle size ratio of the silica A to the silica B, i.e., silica A/silica B, is preferably from 1.2 to 10, more preferably from 1.5 to 5, and even more preferably from 2.0 to 3.0.

The silica B is externally added to the mother toner particles in an amount of preferably 0.1 parts by weight or more, more preferably from 0.1 to 4.0 parts by weight, and even more preferably 0.2 to 2.0 parts by weight, based on 100 parts by weight of the mother toner particles, from the viewpoint of prevention of aggregation during the heat treatment.

A coating ratio of the external additive to the mother toner particles to be subjected to the heat-treating step is preferably 20% or more, and more preferably from 30 to 120%, from the viewpoint of preventions of aggregation and caking.

As the external addition step, a dry mixing method including the step of mixing the external additive and the mother toner particles using a high-speed mixer such as a Henschel mixer or a Super mixer, a V blender, or the like is preferable. The external additive may be previously mixed and then added to a high-speed mixer or a V blender, or separately added thereto.

At the external addition step or later, the heat-treating step including heat-treating a toner to which the external additive has been externally added, which is one of the features of the first embodiment, is carried out as mentioned above. It is preferable that the heat-treating step is carried out after the external addition step.

It is desired that the heat-treating step is carried out under the conditions at a heating temperature t (° C.) satisfying, preferably, $Tg_1 \leqq t \leqq Tm-10$, more preferably, $Tg_1+10 \leqq t \leqq Tm-20$, and even more preferably, $Tg_1+15 \leqq t \leqq Tm-30$, wherein $Tg_1$ is a glass transition temperature (° C.) of a product to be subjected to the heat-treating step; and Tm is a softening point (° C.) of a product to be subjected to the heat-treating step, from the viewpoint of effectively recrystallizing the polyester and controlling shapes of the toner particles while suppressing caking and generation of aggregated product.

The time of the heat-treating step is preferably from 2 to 36 hours, and more preferably from 5 to 30 hours, from the viewpoint of productivity and recrystallization, and controlling shapes.

In addition, the relative humidity during the heat-treating step is preferably from 10 to 70%, and more preferably from 20 to 60%, from the viewpoint of loosening electrostatic aggregation of the external additive and prevention of aggregation of the toner particles.

In the heat-treating step, an oven or the like can be used. For example, when an oven is used, the heat-treating step can be carried out by keeping the melt-kneaded product in the oven at a fixed temperature. In addition, a constant-temperature and -humidity chamber or a vibro-fluidized bed (Model VIA-16D (commercially available in CHUO KAKOHKI CO., LTD)) can be used.

In the first embodiment, the toner particles are conglobated and the average circularity is increased, according to the heat-treating step, as mentioned above. An average circularity of the toner particles after the heat-treating step is preferably from 0.930 to 0.980, and more preferably from 0.940 to 0.970.

After the heat-treating step, it is preferable to carry out a sieving step including sieving the resulting toner, or the toner after the external addition step when the external addition step has been further carried out after the heat-treating step, to remove the aggregated product.

Further, in the toner for electrophotography of the present invention obtained by carrying out a heat-treating step, the second embodiment of the present invention is a toner for electrophotography containing mother toner particles containing a resin binder and a wax and an external additive, wherein the toner has a significant feature that a calorie of an area surrounded by an endothermic curve of the toner determined with a differential scanning calorimeter and a straight line connecting the top of an endothermic peak appearing at the lowest temperature of endothermic peaks derived from the resin binder to the top of an endothermic peak derived from the wax having the lowest melting point of the waxes, an average circularity of the toner, and the content of particles having a particle size of less than 3 μm are all within certain ranges.

In the toner of the second embodiment, a calorie of an area surrounded by an endothermic curve of the toner determined with a differential scanning calorimeter ("DSC Q20," commercially available from TA Instruments. Japan) and a straight line connecting the top of an endothermic peak appearing at the lowest temperature of endothermic peaks derived from the resin binder to the top of an endothermic peak derived from the wax having the lowest melting point of the waxes is from 0.1 to 10.0 J/g, preferably from 1.0 to 7.0 J/g, and even more preferably from 1.0 to 5.0 J/g. The calorie is determined according to the method described in Examples set forth below. The above-mentioned calorie is larger as the content of the crystalline polyester in which crystalline structure collapses increases and also the content of the wax having a low melting point increases. Therefore, the content of the crystalline polyester in which crystalline structure collapses is decreased by the heat-treating step set forth below, or the like, and the content of the wax having a low melting point is decreased, whereby the calorie can be lowered. Means for decreasing the content of the crystalline polyester in which crystalline structure collapses include, for example, a process including carrying out the heat-treating step set forth below in the preparation process of the toner.

The toner of the second embodiment has an average circularity of from 0.940 to 0.980, preferably from 0.950 to 0.970, and more preferably from 0.955 to 0.960, from the viewpoint of suppressing generation of fine powders, which is problematic during durability printing. The average circularity of the toner is an average calculated according to the following equation:

$$\text{Circularity} = \frac{\text{Circumferential Length of Circle Having Same Area As Projected Image of Particles}}{\text{Circumferential Length of Projected Image of Particles}}$$

A "circumferential length of a circle having the same area as a projected image of particles" and a "circumferential length of a projected image of particles" can be obtained by carrying out a determination in a water dispersion system using, for example, a flow particle image analyzer (FPIA-1000, FPIA-2000 or FPIA-3000, commercially available from SYSMEX CORPORAION). In addition, the value according to the above-mentioned analyzer is obtained as an average of thousands of particles, at least 3,000 particles. Therefore, reliability of the average circularity in the present invention is very high. Incidentally, in the present specification, an apparatus for measuring average circularity is not limited to the above apparatus, and the average circularity may be determined with any type of apparatus as long as the average circularity can be obtained on the basis of the above equation according to the same principle.

In the toner of the second embodiment, particles having a particle size of less than 3 μm are contained in an amount of 5% by number or less, preferably 4% by number or less, and more preferably 3% by number or less, from the viewpoint of improvement in durability. The particle size and the content of particles having a particle size of less than 3 μm calculated as the number (% by number) are determined according to the method described in Examples set forth below.

The toner of the second embodiment has a glass transition temperature of preferably from 48° to 65° C., and more preferably from 50° to 60° C., from the viewpoint of storage property.

In addition, a BET specific surface area of a toner is large when the number of fine powders of the toner is large, a particle size of the external additive is small, or the external additive insufficiently adheres to the toner surface. Therefore, when a BET specific surface area is too large, an adverse effect may be caused on durability of the toner. From the above viewpoint, a BET specific surface area is preferably 2.5 $m^2/g$ or less, more preferably from 0.5 to 2.5 $m^2/g$, and even more preferably from 0.7 to 2.0 $m^2/g$. The BET specific surface area can be determined by nitrogen absorption method.

The crystalline polyester and the amorphous polyester in the second embodiment are the same as those described in the first embodiment.

The crystalline polyester is contained in an amount of preferably from 2 to 35% by weight, and more preferably from 3 to 30% by weight, of the resin binder, from the viewpoint of improvements in durability, transfer efficiency and image density.

In addition, when the resin binder contains the amorphous polyester, a weight ratio of the crystalline polyester to the amorphous polyester, i.e., crystalline polyester/amorphous polyester, is preferably from 3/97 to 35/65, and more preferably 5/95 to 30/70, from the viewpoint of improvements in durability, transfer efficiency and image density.

In the second embodiment, besides the crystalline polyester and the amorphous polyester, other resin binders may be properly used within the range which would not impair the effects of the present invention. Other resin binders include resin binders other than polyester, such as vinyl resins, epoxy resins, polycarbonates, and polyurethanes, and the like. The crystalline polyester and the amorphous polyester are contained in a total amount of preferably 80% by weight or more, and more preferably 90% by weight or more, of the resin binder, from the viewpoint of low-temperature fixing ability, but not particularly limited thereto.

The wax in the second embodiment includes natural ester waxes such as carnauba wax and rice wax; synthetic waxes such as polypropylene wax, polyethylene wax and Fischer-Tropsch wax; synthetic ester waxes of pentaerythritol and a fatty acid such as behenic acid, stearic acid, and palmitic acid; petroleum waxes such as paraffin waxes; coal waxes such as montan wax; alcohol waxes; and the like. These waxes may be contained alone or in admixture of two or more kinds. Among them, carnauba wax, pentaerythritol behenate wax and pentaerythritol stearate wax are preferable, and carnauba wax and pentaerythritol stearate wax are more preferable, from the viewpoint of offset resistance and durability.

The wax has a melting point of preferably from 50° to 120° C., more preferably from 60° to 120° C., and even more preferably from 70° to 90° C., from the viewpoint of low-temperature fixing ability and offset resistance.

The wax is contained in an amount of preferably 0.5 parts by weight or more, based on 100 parts by weight of the resin binder, from the viewpoint of offset resistance, and more preferably from 0.5 to 5 parts by weight, and even more preferably from 1 to 3 parts by weight, from the viewpoint of prevention of blocking and durability during the heat treatment.

As in the first embodiment, the mother toner particles may further properly contain an additive such as a colorant, a releasing agent, a charge control agent, a magnetic powder, a fluidity improver, an electric conductivity modifier, an extender, a reinforcing filler such as a fibrous substance, an antioxidant, an anti-aging agent, or a cleanability improver.

The toner for electrophotography of the second embodiment can be obtained through a melt-kneading step including melt-kneading the raw materials of the mother toner particles containing the resin binder containing the crystalline polyester and the colorant or the like properly used, a pulverization step including pulverizing the resulting melt-kneaded product, a classifying step including classifying the resulting pulverized product, to give the mother toner particles, and an external addition step including mixing the resulting mother toner particles and the external additive. In the second embodiment, it is preferable that the heat-treating step is carried out at the pulverization step or later. The heat-treating step is carried out, whereby recrystallization of a crystalline structure of crystalline polyester that has collapsed can be enhanced, the above-mentioned calorie which is a feature of the second embodiment can be controlled, and the circularity can be increased as well. The heat-treating step may be carried out after the classifying step or after the external addition step, and is carried out preferably after the external addition step from the viewpoint of suppressing blocking during the heat treatment.

It is desired that the heat-treating step is carried out under the conditions at a heating temperature t (° C.) satisfying, $$Tg_1 \leqq t \leqq Tm-10,$$

preferably, $Tg_1+5 \leqq t \leqq Tm-10$,
more preferably, $Tg_1+10 \leqq t \leqq Tm-20$, and
even more preferably, $Tg_1+15 \leqq t \leqq Tm-30$,
wherein $Tg_1$ is a glass transition temperature (° C.) of a product to be subjected to the heat-treating step; and Tm is a softening point (° C.) of a product to be subjected to the heat-treating step.

The time of the heat-treating step is preferably from 2 to 36 hours, and more preferably from 5 to 30 hours, from the viewpoint of productivity and controlling shapes.

In addition, the relative humidity during the heat-treating step is preferably from 10 to 70%, and more preferably from 20 to 60%, from the viewpoint of loosening electrostatic aggregation of the external additive and prevention of aggregation of the toner particles.

Incidentally, when the heat-treating step is carried out after the external addition step, a coating ratio of the external additive before the heat-treating step is preferably 50% or more, and more preferably from 70 to 120%, from the viewpoint of caking during heating, prevention of generation of the aggregated product, and fixing ability.

In the heat-treating step, an oven or the like can be used. For example, when an oven is used, the heat-treating step can be carried out by keeping the melt-kneaded product in the oven at a fixed temperature. In addition, a constant-temperature and -humidity chamber or a vibro-fluidized bed (Model VIA-16D (commercially available in CHUO KAKOHKI CO., LTD)) can be used.

Each of the steps other than the heat-treating step will be explained hereinbelow.

The melt-kneading step is a step including melt-kneading the raw materials such as the resin binder containing at least the crystalline polyester and the colorant properly used. It is preferable that the raw materials such as the crystalline polyester and the colorant, to be subjected to the melt-kneading step are mixed with a Henschel mixer or the like, and the mixture is thereafter subjected to the melt-kneading step.

The melt-kneading of the raw materials can be carried out using a known kneader such as a closed type kneader, a single-screw or twin-screw extruder, or an open-roller type kneader, and it is preferable to use a twin-screw extruder. The temperature for the melt-kneading is not particularly limited as long as each of the raw materials is sufficiently miscible with each other.

The melt-kneaded product obtained according to the melt-kneading step is rolled and then cooled. The methods of rolling and cooling are not particularly limited. Means for rolling includes a mill roller, a mill drum, and the like, and means for cooling includes an air-cooling system, a water-cooling system, a steel cooling belt system, and the like. A distance between mill rollers or mill drums is adjusted, whereby the thickness after rolling can be adjusted.

After rolling, a thickness of melt-kneaded product to be subjected to cooling is preferably 3 mm or more, and more preferably from 4 to 6 mm, from the viewpoint of improvement in dispersibility of the wax and productivity.

The pulverization step is a step including pulverizing the resulting melt-kneaded product to a volume-median particle size of preferably 20 μm or less and more preferably 10 μm or less. The melt-kneaded product is properly cooled to an extent that the product is pulverizable, and thereafter subjected to the pulverization step and the classifying step.

The pulverization step may be carried out in divided multi-stages. For example, the melt-kneaded product may be roughly pulverized to a size of from 1 to 5 mm or so and thereafter further finely pulverized. In addition, in order to improve productivity during the pulverization and classifying steps, the melt-kneaded product may be mixed with fine inorganic particles such as hydrophobic silica and thereafter pulverized.

The pulverizer used in the pulverization step is not particularly limited. For example, the pulverizer used preferably in the rough pulverization includes an atomizer, Rotoplex, and the like, and the pulverizer used preferably in the fine pulverization includes a jet mill, an impact type mill, a rotary mechanical mill, and the like.

The classifier used in the classifying step includes an air classifier, a rotor type classifier, a sieve classifier, and the like. During the classifying step, the pulverized product which is insufficiently pulverized and removed may be subjected to the pulverization step again. In addition, the classifying step may be properly carried out after the external addition step set forth below and the heat-treating step.

The external additive includes fine inorganic particles made of silica, alumina, titania, zirconia, tin oxide, zinc oxide or the like. Among them, silica having a small specific gravity is preferable from the viewpoint of prevention of embedment.

The silica is preferably a hydrophobic silica which has been hydrophobically treated, from the viewpoint of environmental stability. The method of hydrophobic treatment of the silica is not particularly limited. The hydrophobic treatment agent includes hexamethyldisilazane (HMDS), dimethyldichlorosilane, silicone oil, methyltriethoxysilane, and the like. Among them, hexamethyldisilazane is preferable. The amount of the hydrophobic treatment agent is preferably from 1 to 7 $mg/m^2$ per surface area of the silica.

The external additive has an average particle size of preferably from 3 to 300 nm, and more preferably from 5 to 100 nm, from the viewpoint of triboelectric chargeability and prevention of damage to the photoconductor. The external addition step is carried out either before or after the heat-treating step, and besides, the external addition step may be further carried out after the heat-treating step. The external additive used in the external addition step before the heat-treating step has an average particle size of preferably from 20 to 120 nm, and more preferably from 30 to 100 nm, from the viewpoint of prevention of embedment into the toner and homogenously adhering to the toner surface during heating.

The external additive is contained in an amount of preferably from 0.1 to 5 parts by weight, and more preferably 0.3 to 3 parts by weight, based on 100 parts by weight of the mother toner particles.

As the external addition step, a dry mixing method including the step of mixing the external additive and the mother toner particles using a high-speed mixer such as a Henschel mixer or a Super mixer, a V blender, or the like is preferable. The external additive may be previously mixed and then added to a high-speed mixer or a V blender, or separately added thereto.

Upon the preparation of the toner of the second embodiment, when the heat-treating step is carried out after the external addition step, a coating ratio of the external additive to the product to be subjected to the heat-treating step is preferably 20% or more, and more preferably from 30 to 120%, from the viewpoint of prevention of aggregation of the toner during the heat-treating step.

After the external addition step, it is preferable to carry out a sieving step including sieving the toner to remove rough powders (aggregated product). When the above-mentioned heat-treating step and the sieving step are carried out after the external addition step, it is preferable to carry out the heat-treating step between the external addition step and the sieving step.

The toner for electrophotography of the present invention can be used without being limited by a developing method, and shows an excellent low-temperature fixing ability, storage property, and durability even in a high-speed continuous printing. Therefore, the toner of the present invention can be suitably used not only as a toner for monocomponent development, but also as a toner for two-component development, in which high durability is required. Therefore, the toner of the present invention can be also used as a two-component developer by mixing the toner with a carrier.

In the present invention, as a carrier, it is preferable to use a carrier having a low saturated magnetization, which forms a soft magnetic brush, from the viewpoint of the properties of fixed images. The carrier has a saturated magnetization of preferably from 40 to 100 $Am^2/kg$, and more preferably from 50 to 90 $Am^2/kg$. A saturated magnetization is preferably 100 $Am^2/kg$ or less from the viewpoint of adjusting hardness of the magnetic brush and retaining tone reproducibility, and is preferably 40 $Am^2/kg$ or more from the viewpoint of preventing carrier adhesion and toner scattering.

As a core material for the carrier, a core material made from any known materials can be used without particular limitation. The core material includes, for example, ferromagnetic metals such as iron, cobalt and nickel; alloys and compounds such as magnetite, hematite, ferrite, copper-zinc-magnesium-based ferrite, manganese-based ferrite, and magnesium-based ferrite; glass beads; and the like. Among them, iron powder, magnetite, ferrite, copper-zinc-magnesium-based ferrite, manganese-based ferrite, and magnesium-based ferrite are preferable from the viewpoint of triboelectric chargeability, and ferrite, copper-zinc-magnesium-based ferrite, manganese-based ferrite, and magnesium-based ferrite are more preferable from the viewpoint of image quality.

The surface of the carrier is preferably coated with a resin from the viewpoint of prevention of toner spent. The resin for coating the surface of the carrier varies depending upon the materials for the toner. The resin includes, for example, a fluororesin such as a polytetrafluoroethylene, a monochlorotrifluoroethylene polymer, and a poly(vinylidene fluoride); a silicone resin such as a polydimethylsiloxane; a polyester; a styrenic resin; an acrylic resin; a polyamide; a polyvinyl butyral; an aminoacrylate resin; and the like. These resins can be used alone or in admixture of two or more kinds. When the toner is negatively chargeable, a silicone resin is preferable from the viewpoint of triboelectric chargeability and the surface energy. The method of coating the core material by the resin includes, for example, a method including the steps of dissolving or suspending a coating material such as a resin in a solvent, and applying the resulting solution or suspension to the core material to allow the resin to adhere thereto; a method including the step of simply mixing the core material with the resin in powdery forms; and the like, and is not particularly limited.

In the two-component developer obtained by mixing the toner and the carrier, a weight ratio of the toner to the carrier, i.e., toner/carrier, is preferably from 1/99 to 10/90, and more preferably from 2/98 to 8/92.

In addition, the toner of the present invention and a two-component developer using the toner are excellent in low-temperature fixing ability, storage property and durability, and the high-quality fixed image can be maintained. Therefore, the toner and the two-component developer can be suitably used in a method of forming fixed images, including the step of applying a high-speed development device having a linear speed of 750 mm/sec or more, and preferably from 850 to 2000 mm/sec. In addition, the toner of the present invention contains the crystalline polyester which is excellent in low-temperature fixing ability, can maintain storage property and durability by heat treatment, and can lower adhesive strength by controlling shapes, whereby transfer efficiency is improved, and especially, the toner and the two-component developer can be also suitably used in a non-contact development system such as a jumping system.

In addition, the toner of the present invention and a two-component developer using the toner contain the crystalline polyester which is excellent in low-temperature fixing ability, and can maintain storage property and durability by the heat-treating step. Therefore, the toner of the present invention and the two-component developer can be also suitably used for a non-contact fixing type image-forming apparatus which do not involve pressure for fixing. The non-contact fixing type image-forming apparatus includes a fixing device of flash fixing, oven fixing, or belt nip system, and the like.

EXAMPLES

The following examples further describe and demonstrate embodiments of the present invention. The examples are given solely for the purposes of illustration and are not to be construed as limitations of the present invention.

First Embodiment

Softening Points (Tm) of Resin and Product to Be Subjected To Heat-Treating Step The softening point refers to a temperature at which a half the amount of the sample flows out when plotting a downward movement of a plunger against temperature, as determined by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Highest Temperature of Endothermic Peak of Resin]

The highest temperature of endothermic peak is determined using a differential scanning calorimeter ("DSC210," commercially available from Seiko Instruments, Inc.), by raising its temperature to 200° C., cooling the hot sample from this temperature to 0° C. at a cooling rate of 10° C./min, and thereafter heating the sample so as to raise the temperature at a rate of 10° C./min. Among the endothermic peaks observed, the temperature of an endothermic peak on the highest temperature side is defined as a highest temperature of endothermic peak.

[Glass Transition Temperature of Resin]

The glass transition temperature is determined using a differential scanning calorimeter ("DSC210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min. When a difference between the highest temperature of endothermic peak and the softening point is within 20° C., a temperature of an intersection of the extension of the baseline of equal to or lower than the temperature of a peak observed at a temperature lower than the highest temperature of endothermic peak and the tangential line showing the maximum inclination between the kick-off of the peak and the top of the peak is read as a glass transition temperature. When a difference between the highest temperature of endothermic peak and the softening point exceeds 20° C., a temperature of an intersection of the extension of the baseline of equal to or lower than the highest temperature of endothermic peak and the tangential line showing the maximum inclination between the kick-off of the peak and the top of the peak is read as a glass transition temperature.

[Glass Transition Temperature (Tg) of Product to Be Subjected to Heat-Treating Step]

In an endothermic curve obtained upon raising a temperature of the sample from −20° C. to 160° C. at a rate of 10° C./min using a differential scanning calorimeter ("DSC Q20," commercially available from TA Instruments. Japan), a temperature of an intersection of the extension of the baseline of equal to or lower than the temperature of a peak observed at the lowest temperature of endothermic peaks and the tangential line showing the maximum inclination between the kick-off of the peak and the top of the peak is read as a glass transition temperature (Tg).

[Acid Value of Resin]

The acid value is determined by a method according to JIS K0070 except that only the determination solvent was changed from a mixed solvent of ethanol and ether as prescribed in JIS K0070 to a mixed solvent of acetone and toluene (volume ratio of acetone:toluene=1:1).

[Volume-Median Particle Size ($D_{50}$) of Toner]

Measuring Apparatus: Coulter Multisizer II (commercially available from Beckman Coulter K.K.)

Aperture Diameter: 50 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: A 5% electrolytic solution of "EMULGEN 109P" (commercially available from Kao Corporation, polyoxyethylene lauryl ether, HLB: 13.6)

Dispersion Conditions: Ten milligrams of a test sample is added to 5 ml of the dispersion, and the resulting mixture is dispersed in an ultrasonic disperser for 1 minute. Thereafter, 25 ml of the electrolytic solution is added to the dispersion, and the resulting mixture is dispersed in the ultrasonic disperser for another 1 minute.

Measurement Conditions: One-hundred milliliters of the electrolytic solution and the dispersion are added to a beaker, and the particle sizes of 30,000 particles are determined under the conditions of a concentration satisfying that the determination for 30,000 particles are completed in 20 seconds. The volume-median particle size ($D_{50}$) is obtained from the particle size distribution.

[Average Circularity of Toner]

Measuring Apparatus: FPIA-3000 (commercially available from SYSMEX CORPORAION)

Standard Unit (objective lens with a magnification of 10 times)

Measurement Mode of HPF

Version 00-10

Dispersion: A 5% by weight of electrolytic solution of "EMULGEN 109P" (commercially available from Kao Corporation, polyoxyethylene lauryl ether, HLB: 13.6)

Dispersion Conditions: Ten milligrams of a test sample is added to 10 ml of the dispersion, and the mixture is dispersed in an ultrasonic disperser for 1 minute. Thereafter, 10 ml of distilled water is added to the dispersion, and the mixture is dispersed in the ultrasonic disperser for another 2 minutes.

Measurement Conditions: The average circularity of the toner dispersed in the dispersion is determined in the particulate concentration of from 1,800 to 2,200 particles at 20° C.

[Average Particle Size of External Additive]

The average particle size of an external additive refers to a number-average particle size. Particle sizes (an average of a major axis and a minor axis) of 500 particles are determined from photographs taken with a scanning electron microscope (SEM), and the average thereof is defined as an average particle size.

[Coating Ratio of External Additive]

The coating ratio is calculated by the following formula:

$$\text{Coating Ratio (\%)} = \sqrt{3}/2\pi \times (D \cdot \rho s)/(d \cdot \rho s) \times C \times 100$$

wherein D is a volume-median particle size ($D_{50}$) of mother toner particles (μm); d is an average particle size of an external additive (μm); ρt is a specific gravity of mother toner particles; ρs is a specific gravity of an external additive; and C is a weight ratio of mother toner particles to an external additive, i.e., external additive/mother toner particles.

A total coating ratio of the external additive refers to the sum of the coating ratios calculated for each of the external additives.

[Saturated Magnetization of Carrier]

(1) A carrier is filled in a plastic case with a lid with tapping, the case having an outer diameter of 7 mm (an inner diameter of 6 mm) and a height of 5 mm. The mass of the carrier is determined from the difference between the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturated magnetization is determined by applying a magnetic field of 79.6 kA/m, with vibrating the plastic case using the vibration function. The value obtained is calculated as the saturated magnetization per unit mass, in consideration of the mass of the filled carrier.

Production Example 1-1 for Amorphous Polyester

A 5-liter four-necked glass flask was charged with the raw material monomers shown in Table 1-1 (the alcohol component and the carboxylic acid component) together with 8 g of tin (II) octylate as an etherification catalyst. Then, the flask was equipped with a thermometer, a stainless-steel stirrer, a reflux condenser, and a nitrogen inlet tube. The ingredients in the flask were reacted under nitrogen gas stream in an electrically heated mantle at 220° C. over a period of 8 hours while stirring, and then reacted at 8.3 kPa for 1 hour. Thereafter, the ingredients were further reacted at 210° C. until a desired softening point was reached, to give resins 1-A to 1-C.

TABLE 1-1

| | Resin 1-A | Resin 1-B | Resin 1-C |
|---|---|---|---|
| Alcohol Component | | | |
| BPA-PO[1)] | 2800 g (100) | 1111 g (50) | 1082 g (50) |
| BPA-EO[2)] | — | 1032 g (50) | 1005 g (50) |
| Carboxylic Acid Component | | | |

TABLE 1-1-continued

| | Resin 1-A | Resin 1-B | Resin 1-C |
|---|---|---|---|
| Fumaric Acid | 980 g (106) | 552 g (75) | — |
| Terephthalic Acid | — | — | 770 g (75) |
| Anhydrous Trimellitic Acid | — | 305 g (25) | 143 g (12) |
| Softening Point (° C.) | 100 | 148 | 105 |
| Glass Transition Temp. (° C.) | 57 | 60 | 65 |
| Highest Temp. of Endothermic Peak (° C.) | 67 | 65 | 70 |
| Acid Value (mgKOH/g) | 20 | 25 | 20 |

Note)

The value in parentheses is expressed in a molar ratio, based on 100 moles of the total amount of the alcohol components.

[1)]Polyoxypropylene(2.2)-2,2-bis(4-hydroxyphenyl)propane

[2)]Polyoxyethylene(2.2)-2,2-bis(4-hydroxyphenyl)propane

Production Example 1-1 for Crystalline Polyester

A 5-liter four-necked glass flask was charged with the raw material monomers shown in Table 1-2 (the alcohol component and the carboxylic acid component) and 2 g of hydroquinone. Then, the flask was equipped with a thermometer, a stainless-steel stirrer, a reflux condenser, and a nitrogen inlet tube. The ingredients in the flask were reacted under nitrogen gas stream in an electrically heated mantle at 160° C. over a period of 5 hours while stirring, and then heated to 200° C. to react for 1 hour. Thereafter, the ingredients were further reacted at 8.0 kPa for 1 hour, to give a resin 1-a.

Production Example 1-2 for Crystalline Polyester

A 5-liter four-necked glass flask was charged with the raw material monomers shown in Table 1-2 (the alcohol component and the carboxylic acid component), 2 g of hydroquinone, and 307 g of a polypropylene wax "NP-105" (commercially available from MITSUI CHEMICALS, INC., melting point of 145° C.). Then, the flask was equipped with a thermometer, a stainless-steel stirrer, a reflux condenser, and a nitrogen inlet tube. The ingredients in the flask were reacted under nitrogen gas stream in an electrically heated mantle at 160° C. over a period of 5 hours while stirring, and then heated to 200° C. to react for 1 hour. Thereafter, the ingredients were further reacted at 8.0 kPa for 3 hours, to give a resin 1-b.

TABLE 1-2

| | Resin 1-a | Resin 1-b |
|---|---|---|
| Alcohol Component | | |
| 1,4-Butanediol | — | 1215 g |
| 1,6-Hexanediol | 1508 g | 177 g |
| Carboxylic Acid Component | | |
| Fumaric Acid | 1565 g | 1740 g |
| Softening Point (° C.) | 120 | 122 |
| Highest Temp. of Endothermic Peak [Melting Point] (° C.) | 125 | 110 |

Examples 1-1 to 1-5 and Comparative Examples 1-3, 1-8, and 1-9

The resin binders shown in Tables 1-3 and 1-4, 6 parts by weight of a carbon black "NIPEX60" (commercially available from Degussa), 1 part by weight of a charge control agent "T-77" (commercially available from Hodogaya Chemical Co., Ltd), and 2 parts by weight of a carnauba wax "Carnauba Wax C-1" (commercially available from Kato Yoko) were sufficiently mixed with a Henschel mixer. The mixture was then melt-kneaded at a heating temperature within the barrel of 100° C. and a rotational speed of the screw of 200 r/min and in an amount of injection of 10 kg/hr using a co-rotating twin-screw extruder "PCM-30-30" (commercially available from IKEGAI Corporation) having an entire length of the kneading portion of 1560 mm, a screw diameter of 42 mm, and a barrel inner diameter of 43 mm.

The resulting melt-kneaded product was rolled with a cooling roller, and cooled to a temperature of 25° C. or lower. The resulting cooled product was roughly pulverized to a size of from 1 to 3 mm or so with Rotoplex, thereafter finely pulverized with a jet mill, and classified, to give mother toner particles (specific gravity of 1.2).

One-hundred parts by weight (10 kg) of the resulting mother toner particles, 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) and 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) were supplied in a 75-liter Henschel mixer, as first external additives. The ingredients in the mixer were mixed at a rotational speed of 1500 r/min for 90 seconds, to externally add the first external additives to the surface of the mother toner particles.

Ten kilograms of the toner to which the first external additives were externally added was put in a bucket. While the bucket was held open, the toner was allowed to stand for 24 hours under the conditions shown in Tables 1-3 and 1-4 using a constant-temperature and -humidity chamber, to carry out a heat treatment. Thereafter, the resulting toner was sieved with a shaking sieve comprising a mesh with a sieve opening of 100 μm, to remove rough particles.

Example 1-6

The same procedures as in Example 1-2 were carried out to a sieving step except that a vibro-fluidized bed (Model VIA-16D (commercially available in CHUO KAKOHKI CO., LTD)) was used in place of a constant-temperature and -humidity chamber in the heat-treating step, to give a toner.

Example 1-7

The resulting mother toner particles obtained in the same manner as in Example 1-1 (10 kg) and 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) as a first external additive were supplied in a 75-liter Henschel mixer. The ingredients in the mixer were mixed at a rotational speed of 1500 r/min for 90 seconds, to externally add the first external additive to the surface of the mother toner particles.

Ten kilograms of the toner to which the first external additive was externally added was put in a bucket. While the bucket was held opened, the toner was allowed to stand for 24 hours under the conditions shown in Table 1-3 using a constant-temperature and -humidity chamber, to carry out a heat treatment. Thereafter, the heat-treated toner particles and 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) as a second external additive were supplied in a 75-liter Henschel mixer and mixed at a rotational speed of 1500 r/min for 90 seconds, to further externally add the second external additive to the toner particles. From the toner to which the second additive was externally added were removed rough particles with a shaking sieve comprising a mesh with a sieve opening of 100 μm, to give a toner.

Example 1-8

The same procedures as in Example 1-7 were carried out except that 0.4 parts by weight (40 g) of a hydrophobic silica "R972" (commercially available from Nippon Aerosil Co., LTD., average particle size of 16 nm, specific gravity of 2.3, hydrophobic treatment agent: DMDS) as a first external additive, and 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) and 0.5 parts by weight (50 g) of a hydrophobic silica "R972" (commercially available from Nippon Aerosil Co., LTD., average particle size of 16 nm, specific gravity of 2.3, hydrophobic treatment agent: DMDS) as second external additives, were each used, to give a toner.

Example 1-9

The same procedures as in Example 1-1 were carried out except that 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) as a first external additive was used, to give a toner.

Example 1-10

The same procedures as in Example 1-1 were carried out except that 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) as a first external additive was used, to give a toner.

Comparative Example 1-1

The mother toner particles were obtained in the same manner as in Example 1-1. Thereafter, without externally adding the first external additives to the resulting mother toner particles, the mother toner particles were allowed to stand for 6 hours under the conditions shown in Table 1-4 while the bucket was held open, thereby consequently causing a caking phenomenon. Therefore, the preparation of a toner was stopped.

Comparative Example 1-2

The mother toner particles were obtained in the same manner as in Example 1-1. Thereafter, without externally adding the first external additives to the resulting mother toner particles, the mother toner particles were allowed to stand for 24 hours under the conditions shown in Table 1-4 while the bucket was held open, to carry out a heat treatment. After the heat treatment, 100 parts by weight (10 kg) of the resulting mother toner particles, and 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS)

and 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) as second external additives were supplied in a 75-liter Henschel mixer and mixed at a rotational speed of 1500 r/min for 90 seconds, to externally add the second external additives to the surface of the mother toner particles. From the resulting toner were removed rough particles with a shaking sieve comprising a mesh with a sieve opening of 100 μm, to give a toner.

Comparative Examples 1-4 to 1-7

The same procedures as in Examples 1-2 to 1-5 were carried out, except that the heat-treating step was not carried out after the external addition step, to give a toner.

Photographs of the toners after the heat-treating step, taken with a scanning electron microscope, in Example 1-2 and Comparative Example 1-3 are shown in FIGS. 1 to 4.

Test Example 1-1

Fixing Ability

A toner of each of Examples 1-1 to 1-10 and each of Comparative Examples 1-2 to 1-9 was loaded in a copy machine "MICROLINE 3050" (commercially available from Oki Data Corporation) and the applied bias of the developing roller was adjusted so that the amount of toner was 0.6 $mg/cm^2$. Thereafter, an image was taken out in a step before fixing the image, to give an unfixed image. Further, using an external fixing device which was a modified fixing device for a non-contact fixing type image-forming apparatus "VarioStream 9000" (commercially available from Oce Printing Systems GmbH), the temperature on the sheet was sequentially raised from 90° C. to 150° C. in increments of 10° C., to give fixed images. A "UNICEF Cellophane" (commercially available from MITSUBISHI PENCIL CO., LTD., width: 18 mm, JISZ-1522) was adhered to each of the images fixed at each temperature, and a pressure was applied on a tape with a roller so that a load of 500 g was applied. Thereafter, the tape was stripped away, and image densities before and after strip-away of the tape were determined. The temperature on the sheet at which a fixing ratio, i.e., image density after strip-away of the tape/image density before adhesion of the tape× 100, initially exceeded 90% was defined as the lowest fixing temperature. The sheets used for a fixing test were cardboard commercially available from Sharp Corporation "CopyBond SF-70NA" (75 $g/m^2$). The results are shown in Tables 1-3 and 1-4.

Test Example 1-2

Durability

Three-hundreds and forty-two grams of each of toners of Examples 1-1 to 1-10 and Comparative Examples 1-2 to 1-9 and 5,000 g of a ferrite carrier (volume-average particle size: 60 μm, saturated magnetization: 68 $Am^2/kg$) were mixed, to give a two-component developer. The resulting two-component developer was loaded on a non-contact fixing type image-forming apparatus "VarioStream 9000" (commercially available from Oce Printing Systems GmbH), and a 20,000-sheet durability printing was carried out at a printing ratio of 9% and a linear speed of 1,000 mm/sec. On the way, the presence or absence of filming and the presence or absence of deterioration in image quality due to carrier spent were confirmed every 1,000 sheets. The number of sheets printed when filming was confirmed on the photoconductor or when the total number of white spots caused by filming and black spots caused by charge failure due to carrier spent and deterioration in fluidity due to generation of fine powders exceeded 30 was defined as durably printed sheet count.

Further, the optical reflective densities (OD) of black solid portions in images of the last 3 sheets (from 4998th sheet to 5000th sheet) in a 5000-sheet durability printing were determined as the image density with a reflective densitometer "RD-915" (commercially available from Macbeth Process Measurements Co.), and the image density was evaluated in accordance with the following evaluation criteria.

[Evaluation Criteria of Image Density]

◎: The image density is 1.8 or more.

○: The image density is 1.7 or more and less than 1.8.

Δ: The image density is 1.5 or more and less than 1.7.

x: The image density is less than 1.5.

In addition, the number of white spots on the 3 sheets of fixed images collected for determination of the image density was visually counted. The numbers of white spots and black spots per one sheet were calculated, and the evaluations were respectively carried out as white spots and black spots in accordance with the following evaluation criteria. Here, white spots are caused by aggregated product of the free external additive and black spots are caused by aggregated product of the toner, respectively. The above results are shown in Tables 1-3 and 1-4.

[Evaluation Criteria of White Spots]

○: The number of white spots per one sheet is less than 5.

Δ: The number of white spots per one sheet is 5 or more and less than 10.

x: The number of white spots per one sheet is 10 or more.

[Evaluation Criteria of Black Spots]

○: The number of black spots per one sheet is less than 5.

Δ: The number of black spots per one sheet is 5 or more and less than 10.

x: The number of black spots per one sheet is 10 or more.

Test Example 1-3

Storage Property

A 50 ml polyethylene bottle was charged with 5 g of each of toners of Examples 1-1 to 1-10 and Comparative Examples 1-2 to 1-9, and the toner was allowed to stand in an environment at a temperature of 50° C. and a relative humidity of 60% for 48 hours. Thereafter, the toner was sieved with a mesh having a sieve opening of 100 μm, and the toner remaining on the mesh was weighed. The storage property was evaluated in accordance with the following evaluation criteria. The above results are shown in Tables 1-3 and 1-4.

[Evaluation Criteria]

○: The remaining toner is less than 0.5 g.

ΔA: The remaining toner is 0.5 g or more and less than 1 g.

x: The remaining toner is 1 g or more.

TABLE 1-3

| | Examples | | | | | | | | | |
|---|---|---|---|---|---|---|---|---|---|---|
| | 1-1 | 1-2 | 1-3 | 1-4 | 1-5 | 1-6 | 1-7 | 1-8 | 1-9 | 1-10 |
| Resin Binder | | | | | | | | | | |
| Resin 1-A (Parts by Wt.) | 80 | 80 | 75 | 70 | 60 | 80 | 80 | 80 | 80 | 80 |
| Resin 1-a (Parts by Wt.) | — | 20 | 25 | 30 | 40 | 20 | — | — | — | — |
| Resin 1-b (Parts by Wt.) | 20 | — | — | — | — | — | 20 | 20 | 20 | 20 |
| $D_{50}$ (μm) of Particles (Product) to Be Subjected to Heat-Treating Step | 8.4 | 8.4 | 8.5 | 8.3 | 8.5 | 8.4 | 8.4 | 8.4 | 8.4 | 8.4 |
| First External Additive | | | | | | | | | | |
| R-972 (Parts by Wt.) | 0.9 | 0.9 | 0.9 | 0.9 | 0.9 | 0.9 | — | 0.4 | — | 0.9 |
| NAX50 (Parts by Wt.) | 1.0 | 1.0 | 1.0 | 1.0 | 1.0 | 1.0 | 1.0 | — | 1.0 | — |
| Coating Ratio (%) | 98 | 98 | 99 | 97 | 99 | 98 | 31 | 31 | 31 | 69 |
| Tg (Upper Side) and Tm (Lower Side) (° C.) of Particles (Product) to Be Subjected to Heat-Treating Step | 36<br>98 | 32<br>95 | 35<br>96 | 39<br>96 | 49<br>95 | 32<br>95 | 36<br>98 | 36<br>98 | 36<br>98 | 36<br>98 |
| Conditions of Heat Treatment (Temp./RH) | 50° C./40% | 50° C./40% | 50° C./40% | 50° C./40% | 50° C./40% | 50° C./40% | 50° C./40% | 50° C./40% | 50° C./40% | 50° C./40% |
| Aggregated Product After Heat-Treating Step | None | None | None | None | Slightly Generated | None | None | Slightly Generated | None | None |
| Second External Additive | | | | | | | | | | |
| R-972 (Parts by Wt.) | — | — | — | — | — | — | 0.9 | 0.5 | — | — |
| NAX50 (Parts by Wt.) | — | — | — | — | — | — | — | 1.0 | — | — |
| Average Circularity of Toner | 0.957 | 0.955 | 0.950 | 0.949 | 0.943 | 0.955 | 0.958 | 0.950 | 0.952 | 0.955 |
| Lowest Fixing Temp. (° C.) | 120 | 120 | 115 | 120 | 120 | 120 | 120 | 120 | 115 | 115 |
| Durably Printed Sheet Count | 20,000 or More | 20,000 or More | 20,000 or More | 20,000 or More | 15,000 | 20,000 or More | 20,000 or More | 20,000 or More | 15,000 | 20,000 or More |
| Image Density | ◎ (1.9) | ◎ (1.8) | ○ (1.7) | ○ (1.7) | Δ (1.6) | ◎ (1.8) | ○ (1.7) | Δ (1.6) | Δ (1.5) | Δ (1.5) |
| White Spots | ○ (1) | ○ (2) | ○ (2) | ○ (4) | ○ (3) | ○ (2) | Δ (5) | Δ (9) | ○ (3) | ○ (2) |
| Black Spots | ○ (1) | ○ (1) | ○ (2) | ○ (2) | ○ (4) | ○ (1) | ○ (4) | Δ (9) | ○ (3) | ○ (3) |
| Storage Property | ○ | ○ | ○ | ○ | ○ | ○ | ○ | ○ | ○ | ○ |

40

TABLE 1-4

| | Comparative Examples | | | | | | | | |
|---|---|---|---|---|---|---|---|---|---|
| | 1-1 | 1-2 | 1-3 | 1-4 | 1-5 | 1-6 | 1-7 | 1-8 | 1-9 |
| Resin Binder | | | | | | | | | |
| Resin 1-A (Parts by Wt.) | 80 | 80 | 100 | 80 | 75 | 70 | 60 | — | — |
| Resin 1-B (Parts by Wt.) | — | — | — | — | — | — | — | 80 | — |
| Resin 1-C (Parts by Wt.) | — | — | — | — | — | — | — | — | 80 |
| Resin 1-a (Parts by Wt.) | — | — | — | 20 | 25 | 30 | 40 | — | — |
| Resin 1-b (Parts by Wt.) | 20 | 20 | — | — | — | — | — | 20 | 20 |
| $D_{50}$ (μm) of Particles (Product) to Be Subjected to Heat-Treating Step | 8.4 | 8.4 | 8.5 | 8.4 | 8.5 | 8.3 | 8.5 | 8.5 | 8.4 |
| First External Additive | | | | | | | | | |
| R-972 (Parts by Wt.) | — | — | 0.9 | 0.9 | 0.9 | 0.9 | 0.9 | 0.9 | 0.9 |
| NAX50 (Parts by Wt.) | — | — | 1.0 | 1.0 | 1.0 | 1.0 | 1.0 | 1.0 | 1.0 |
| Coating Ratio (%) | — | — | 99 | 98 | 99 | 97 | 99 | 99 | 98 |
| Tg (Upper Side) and Tm (Lower Side) (° C.) of Particles (Product) to Be Subjected to Heat-Treating Step | 36<br>98 | 36<br>98 | 56<br>107 | 32<br>95 | 35<br>96 | 39<br>96 | 49<br>95 | 39<br>122 | 45<br>105 |
| Conditions of Heat Treatment (Temp./RH) | 60° C./50% | 45° C./50% | 60° C./40% | — | — | — | — | 50° C./40% | 50° C./40% |
| Aggregated Product After Heat-Treating Step | Caking | Generated | — | — | — | — | — | None | None |
| Second External Additive | | | | | | | | | |
| R-972 (Parts by Wt.) | Preparation | 0.9 | — | — | — | — | — | — | — |

TABLE 1-4-continued

| | Comparative Examples | | | | | | | | |
|---|---|---|---|---|---|---|---|---|---|
| | 1-1 | 1-2 | 1-3 | 1-4 | 1-5 | 1-6 | 1-7 | 1-8 | 1-9 |
| NAX50 (Parts by Wt.) | Was Stopped | 1.0 | — | — | — | — | — | — | — |
| Average Circularity of Toner | Due to | 0.951 | 0.938 | 0.939 | 0.942 | 0.941 | 0.941 | 0.935 | 0.937 |
| Lowest Fixing Temp. (° C.) | Generation | 120 | 140 | 120 | 120 | 120 | 120 | 145 | 135 |
| Durably Printed Sheet Count | of Caking | 20,000 or More | 20,000 or More | 10,000 | 6,000 | 6,000 | 200 | 20,000 or More | 20,000 or More |
| Image Density | | ○ (1.7) | Δ (1.6) | Δ (1.6) | Δ (1.5) | Δ (1.5) | — | ○ (1.7) | ○ (1.5) |
| White Spots | | X (19) | ○ (4) | X (18) | X (17) | X (16) | — | ○ (4) | ○ (4) |
| Black Spots | | X (27) | ○ (3) | ○ (1) | ○ (3) | ○ (2) | — | ○ (3) | Δ (8) |
| Storage Property | | ○ | ○ | Δ | X | X | X | ○ | ○ |

It can be seen from the above results that, the toners of Examples 1-1 to 1-10 totally have a high average circularity and are excellent in both low-temperature fixing ability and durability, as compared to the toners of Comparative Examples 1-1 to 1-9. On the other hand, it can be seen from the results of Comparative Examples 1-1 and 1-2 that, when the heat-treating step is carried out before the external addition step, a caking phenomenon is more likely to be caused, and generation of white spots and black spots involved with aggregation of the toner and the external additive are remarkable even though the toner is prepared adjusting the conditions of heat treatment. In addition, the toner of Comparative Example 1-3 using only the crystalline polyester as the resin binder is poor in low-temperature fixing ability, and the toners of Comparative Examples 1-4 to 1-7 in which the heat-treating step is not carried out are poor in durability and storage property. In addition, the toners of Comparative Examples 1-8 and 1-9 using the nonlinear crystalline polyester are poor in low-temperature fixing ability.

Second Embodiment

Softening Points (Tm) of Resin and Product to Be Subjected To Heat-Treating Step The softening point is determined in the same manner as in the first embodiment.

[Highest Temperature of Endothermic Peak of Resin]

The highest temperature of endothermic peak is determined in the same manner as in the first embodiment.

[Glass Transition Temperature of Resin]

The grass transition temperature is determined in the same manner as in the first embodiment.

[Glass Transition Temperatures (Tg) of Product to Be Subjected to Heat-Treating Step and Toner and Calorie of Area Surrounded by Endothermic Curve and Straight Line Connecting Top of Endothermic Peak Appearing at Lowest Temperature of Endothermic Peaks Derived from Resin Binder to Top of Endothermic Peak Derived from Wax Having Lowest Melting Point of Waxes]

In an endothermic curve obtained upon raising a temperature of the sample from −20° C. to 160° C. at a rate of 10° C./min using a differential scanning calorimeter ("DSC Q20," commercially available from TA Instruments. Japan), the top of an endothermic peak appearing at the lowest temperature of endothermic peaks derived from the resin binder is connected by a straight line to the top of an endothermic peak derived from the wax having the lowest melting point of the waxes, and an area surrounded by the line and the determined curve is obtained and defined as the calorie.

In addition, a temperature of an intersection of the extension of the baseline of equal to or lower than the temperature of a peak observed at the lowest temperature of endothermic peaks and the tangential line showing the maximum inclination between the kick-off of the peak and the top of the peak is read as a glass transition temperature (Tg).

[Acid Value of Resin]

The acid value is determined in the same manner as in the first embodiment.

[Melting Point of Wax]

The melting point refers to the maximum peak temperature for heat of fusion, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Volume-Median Particle Size ($D_{50}$) of Toner and Content of Particles Having Particle Size of Less Than 3 μm]

Measuring Apparatus: Coulter Multisizer II (commercially available from Beckman Coulter K.K.)

Aperture Diameter: 50 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: A 5% electrolytic solution of "EMULGEN 109P" (commercially available from Kao Corporation, polyoxyethylene lauryl ether, HLB: 13.6)

Dispersion Conditions: Ten milligrams of a test sample is added to 5 ml of the dispersion, and the resulting mixture is dispersed in an ultrasonic disperser for 1 minute. Thereafter, 25 ml of the electrolytic solution is added to the dispersion, and the resulting mixture is dispersed in the ultrasonic disperser for another 1 minute.

Measurement Conditions: One-hundred milliliters of the electrolytic solution and the dispersion are added to a beaker, and the particle sizes of 30,000 particles are determined under the conditions of a concentration satisfying that the determination for 30,000 particles are completed in 20 seconds. The volume-median particle size ($D_{50}$) and the content of particles having a particle size of less than 3 μm (% by number) are obtained from the particle size distribution.

[Average Circularity of Toner]

The average circularity is determined in the same manner as in the first embodiment.

[Average Particle Size of External Additive]

The average particle size is determined in the same manner as in the first embodiment.

[Coating Ratio of External Additive]

The coating ratio is determined in the same manner as in the first embodiment.

[Saturated Magnetization of Carrier]

The saturated magnetization is determined in the same manner as in the first embodiment.

Production Example 2-1 for Amorphous Polyester

A 5-liter four-necked glass flask was charged with the raw material monomers (the alcohol component and the carboxylic acid component) shown in Table 2-1 together with 8 g of tin (II) octylate as an etherification catalyst. Then, the flask was equipped with a thermometer, a stainless-steel stirrer, a reflux condenser, and a nitrogen inlet tube. The ingredients in the flask were reacted under nitrogen gas stream in an electrically heated mantle at 220° C. over a period of 8 hours while stirring, and then reacted at 8.3 kPa for 1 hour. Thereafter, the ingredients were further reacted at 210° C. until a desired softening point was reached, to give resins 2-A to 2-C.

TABLE 2-1

| | Resin 2-A | Resin 2-B | Resin 2-C |
|---|---|---|---|
| Alcohol Component | | | |
| BPA-PO[1)] | 2800 g | 870 g | 860 g |
| BPA-EO[2)] | — | 1500 g | 2000 g |
| Carboxylic Acid Component | | | |
| Fumaric Acid | 980 g | — | — |
| Terephthalic Acid | — | 1060 g | 1156 g |
| Softening Point (° C.) | 100 | 110 | 100 |
| Glass Transition Temp. (° C.) | 57 | 67 | 60 |
| Highest Temp. of Endothermic Peak (° C.) | 67 | 75 | 68 |
| Acid Value (mgKOH/g) | 20 | 4 | 3 |

[1)]Polyoxypropylene(2.2)-2,2-bis(4-hydroxyphenyl)propane
[2)]Polyoxyethylene(2.2)-2,2-bis(4-hydroxyphenyl)propane Production Example 2-1 for Crystalline Polyester A 5-liter four-necked glass flask was charged with the raw material monomers (the alcohol component and the carboxylic acid component) shown in Table 2-2 and 2 g of hydroquinone. Then, the flask was equipped with a thermometer, a stainless-steel stirrer, a reflux condenser, and a nitrogen inlet tube. The ingredients in the flask were reacted under nitrogen gas stream in an electrically heated mantle at 160° C. over a period of 5 hours while stirring, and then heated to 200° C. to react for 1 hour. Thereafter, the ingredients were further reacted at 8.0 kPa for 1 hour, to give a resin 2-a.

Production Example 2-2 for Crystalline Polyester

A 5-liter four-necked glass flask was charged with the raw material monomers (the alcohol component and the carboxylic acid component) shown in Table 2-2, 2 g of hydroquinone, and 307 g of a polypropylene wax "NP-105" (commercially available from MITSUI CHEMICALS, INC., melting point of 145° C.). Then, the flask was equipped with a thermometer, a stainless-steel stirrer, a reflux condenser, and a nitrogen inlet tube. The ingredients in the flask were reacted under nitrogen gas stream in an electrically heated mantle at 160° C. over a period of 5 hours while stirring, and then heated to 200° C. to react for 1 hour. Thereafter, the ingredients were further reacted at 8.0 kPa for 3 hours, to give a resin 2-b.

TABLE 2-2

| | Resin 2-a | Resin 2-b |
|---|---|---|
| Alcohol Component | | |
| 1,6-Hexanediol | 1508 g | 1538 g |
| Carboxylic Acid Component | | |
| Fumaric Acid | 1565 g | 1565 g |
| Softening Point (° C.) | 120 | 122 |
| Highest Temp. of Endothermic Peak [Melting Point] (° C.) | 125 | 115 |

Examples 2-1 to 2-6 and Comparative Example 2-1

The resin binders shown in Table 2-3, 6 parts by weight of a carbon black "NIPEX60" (commercially available from Degussa), 1 part by weight of a charge control agent "T-77" (commercially available from Hodogaya Chemical Co., Ltd), and 2 parts by weight of a carnauba wax "Carnauba Wax C-1" (commercially available from Kato Yoko, melting point of 83° C.) were sufficiently mixed with a Henschel mixer. The mixture was then melt-kneaded at a heating temperature within the barrel of 100° C. and a rotational speed of the screw of 200 r/min and in an amount of injection of 10 kg/hr using a co-rotating twin-screw extruder "PCM-30-30" (commercially available from IKEGAI Corporation) having an entire length of the kneading portion of 1560 mm, a screw diameter of 42 mm, and a barrel inner diameter of 43 mm.

The resulting melt-kneaded product was cooled and then roughly pulverized to a size of from 1 to 3 mm or so. Thereafter, the roughly pulverized product was finely pulverized with a jet mill "AFG200" (commercially available from HOSOKAWA ALPINE AG) and then classified with a rotary stream classifier "100TTSP" (commercially available from HOSOKAWA ALPINE AG), to give mother toner particles.

One-hundred parts by weight (10 kg) of the resulting mother toner particles, 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) and 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) were supplied in a 75-liter Henschel mixer. The ingredients in the mixer were mixed at a rotational speed of 1500 r/min for 90 seconds, to externally add the hydrophobic silica to the surface of the mother toner particles.

Ten kilograms of the toner to which the external additives were externally added was put in a bucket. While the bucket was held open, the toner was allowed to stand for 24 hours under the conditions shown in Table 2-3 using a constant-temperature and -humidity chamber, to carry out a heat treatment. Thereafter, the resulting toner was sieved with a shaking sieve comprising a mesh with a sieve opening of 100 μm to remove rough particles therefrom, to give a toner.

Figure 5:
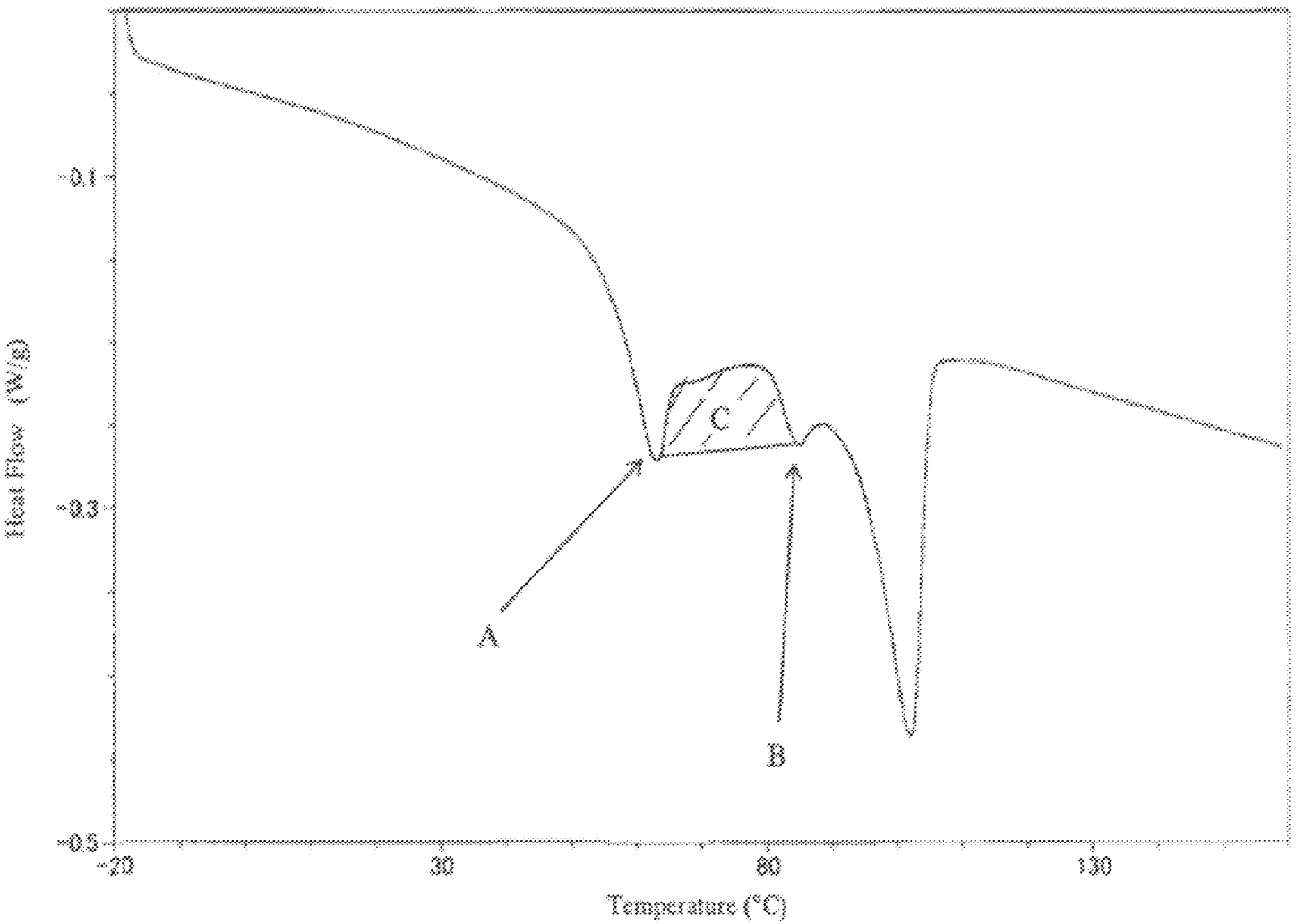
FIG. 5 is a chart of the toner obtained in Example 2-3, determined with a differential scanning calorimeter.

A chart of the toner obtained in Example 2-3, determined with a differential scanning calorimeter is shown in FIG. 5.

Comparative Example 2-2

The same procedures as in Example 2-4 were carried out except that the heat-treating step after the external addition step was not carried out, to give a toner.

Comparative Example 2-3

The same procedures as in Example 2-3 were carried out except that the heat-treating step after the external addition step was not carried out, to give a toner.

Comparative Example 2-4

The same procedures as in Example 2-3 were carried out except that "IDS-2 type" (commercially available from Nippon Pneumatic Mfg. Co., Ltd.) comprising a fine pulverizer in which a roughly pulverized product was collided by means of a jet stream and a classifier in which a fine pulverized product was centrifuged by rotary stream was used for fine pulverization of the roughly pulverized product and classification, to give a toner. However, aggregated product was generated after heat treatment.

Comparative Example 2-5

The raw materials were melt-kneaded in the same manner as in Example 2-2, and thereafter roughly pulverized product having a size of from 1 to 3 mm was obtained. The resulting roughly pulverized product was put in a bucket. While the bucket was held open, the toner was allowed to stand for 24 hours under the conditions shown in Table 2-3 using a constant-temperature and -humidity chamber, to carry out a heat treatment. Thereafter, "IDS-2 type" (commercially available from Nippon Pneumatic Mfg. Co., Ltd.) comprising a fine pulverizer in which a roughly pulverized product was collided by means of a jet stream and a classifier in which the fine pulverized product was centrifuged by rotary stream was used, to give mother toner particles.

One-hundred parts by weight (10 kg) of the resulting mother toner particles, 1.0 part by weight (100 g) of a hydrophobic silica "NAX50" (commercially available from Nippon Aerosil Co., LTD., average particle size of 40 nm, specific gravity of 2.3, hydrophobic treatment agent: HMDS) and 0.9 parts by weight (90 g) of a hydrophobic silica "R972" (commercially available from Nippon Aerosil Co., LTD., average particle size of 16 nm, specific gravity of 2.3, hydrophobic treatment agent: DMDS) were supplied in a 75-liter Henschel mixer. The ingredients in the mixer were mixed at a rotational speed of 1500 r/min for 90 seconds to externally add the hydrophobic silica to the surface of the mother toner particles, to give a toner.

Test Example 2-1

Lowest Fixing Temperature

A toner was loaded in a non-contact developing type copy machine "MICROLINE 3050" (commercially available from Oki Data Corporation) and the applied bias of the developing roller was adjusted so that the amount of toner was 0.6 mg/cm$^2$. Thereafter, an image was taken out in a step before fixing the image, to give an unfixed image. Further, using an external fixing device which was a modified fixing device for a non-contact fixing type image-forming apparatus "VarioStream 9000" (commercially available from Oce Printing Systems GmbH), the temperature on the sheet was sequentially raised from 90° C. to 150° C. in increments of 10° C., to give fixed images. A "UNICEF Cellophane" (commercially available from MITSUBISHI PENCIL CO., LTD., width: 18 mm, JISZ-1522) was adhered to each of the images fixed at each temperature, and a pressure was applied on a tape with a roller so that a load of 500 g was applied. Thereafter, the tape was stripped away, and image densities before and after strip-away of the tape were determined. The temperature on the sheet at which a fixing ratio, i.e., image density after strip-away of the tape/image density before adhesion of the tape× 100, initially exceeded 90% was defined as the lowest fixing temperature. The sheets used for a fixing test were cardboard commercially available from Sharp Corporation "CopyBond SF-70NA" (75 g/m$^2$). The results are shown in Table 2-3.

Test Example 2-2

Transfer Efficiency, Image Density and Durability

Three-hundreds and forty-two grams of the toner and 5,000 g of a ferrite carrier (volume-average particle size: 60 μm, saturated magnetization: 68 Am$^2$/kg) were mixed, to give a two-component developer. The resulting two-component developer was loaded on a non-contact fixing type image-forming apparatus "VarioStream 9000" (commercially available from Oce Printing Systems GmbH), and a durability printing was carried out at a printing ratio of 9% and a linear speed of 1,000 mm/sec for 2 hours. Thereafter, a durability printing was carried out at a printing ratio of 0.15% for 3 hours, and the printer was subjected to emergency shutdown. The amount of toner on the photoconductor (To) and the amount of toner on the paper (Tp) were weighed, and the value obtained by Tp/To×100 was defined as transfer efficiency.

In addition, 3 sheets of the fixed image sample were collected, and the optical reflective densities (OD) of black solid portions in the fixed images were determined as an image density with a reflective densitometer "RD-915" (commercially available from Macbeth Process Measurements Co.).

Thereafter, a durability printing was carried out at a printing ratio of 9% for 20 hours. Then, the amount of toner spent was determined in accordance with the following method, and durability was evaluated in accordance with the following evaluation criteria. The results are shown in Table 2-3.

(1) A two-component developer is passed through a mesh having a sieve opening of 20 μm with a vacuum cleaner. The amount of carbon remaining on the carrier is determined with a carbon analyzer (carbon analyzer, commercially available from HORIBA, Ltd.).

(2) The carrier of which amount of carbon was determined in item (1) is washed with chloroform, to remove a toner adhered to the carrier. After washing, the amount of carbon on the carrier is determined.

(3) The value obtained by subtracting the amount of carbon determined in item (2) from the amount of carbon determined in item (1) is defined as the amount of toner spent. The amount of toner spent is expressed in % by weight based on the carrier.

[Evaluation Criteria of Durability]

◎: The amount of toner spent is less than 0.03% by weight.

○: The amount of toner spent is 0.03% by weight or more and less than 0.15% by weight.

Δ: The amount of toner spent is 0.15% by weight or more and less than 0.30% by weight.

x: The amount of toner spent is 0.30% by weight or more.

Test Example 2-3

Storage Property

A 50 ml polyethylene bottle was charged with 5 g of the toner, and the toner was allowed to stand in an environment at a temperature of 50° C. and a relative humidity of 60% for 48 hours. Thereafter, the toner was sieved with a mesh having a sieve opening of 100 μm, and the toner remaining on the mesh was weighed. The storage property was evaluated in accordance with the following evaluation criteria. The results are shown in Table 2-3.

[Evaluation Criteria]

○: The remaining toner is less than 0.5 g.

Δ: The remaining toner is 0.5 g or more and less than 1 g.

x: The remaining toner is 1 g or more.

TABLE 2-3

| | Examples | | | | | | Comparative Examples | | | | |
|---|---|---|---|---|---|---|---|---|---|---|---|
| | 2-1 | 2-2 | 2-3 | 2-4 | 2-5 | 2-6 | 2-1 | 2-2 | 2-3 | 2-4 | 2-5 |
| Resin Binder | | | | | | | | | | | |
| Amorphous Polyester | | | | | | | | | | | |
| Resin 2-A (Parts by Wt.) | 60 | — | — | — | — | — | — | — | — | — | — |
| Resin 2-B (Parts by Wt.) | 30 | — | — | — | — | — | — | — | — | — | — |
| Resin 2-C (Parts by Wt.) | — | 80 | 80 | 70 | 70 | 60 | 100 | 70 | 80 | 80 | 80 |
| Crystalline Polyester | | | | | | | | | | | |
| Resin 2-a (Parts by Wt.) | — | — | 20 | 30 | 35 | 40 | — | 30 | 20 | 20 | — |
| Resin 2-b (Parts by Wt.) | 10 | 20 | — | — | — | — | — | — | — | — | 20 |
| $D_{50}$ (μm) of Mother Toner Particles | 8.4 | 8.3 | 7.0 | 6.9 | 6.7 | 6.5 | 6.8 | 6.9 | 7.0 | 6.8 | 8.4 |
| Specific Gravity of Mother Toner Particles | 1.2 | 1.2 | 1.2 | 1.2 | 1.2 | 1.2 | 1.2 | 1.2 | 1.2 | 1.2 | 1.2 |
| Coating Ratio (%) of External Additive | 98 | 97 | 82 | 81 | 78 | 76 | 79 | 81 | 82 | 79 | 98 |
| Content of Particles of Less Than 3 μm in Product to Be Subjected to Heat-Treating Step (% by Number) | 2.7 | 3.1 | 3.8 | 3.4 | 3.2 | 3.7 | 3.8 | — | — | 10.6 | 0 |
| Tg (Upper Side) and Tm (Lower Side) (° C.) of Product to Be Subjected to Heat-Treating Step | 43<br>101 | 32<br>95 | 35<br>96 | 41<br>96 | 45<br>96 | 49<br>95 | 58<br>98 | —<br>— | —<br>— | 32<br>95 | 34<br>96 |
| Conditions of Heat Treatment (Temp./RH) | 50° C./40% | 50° C./40% | 50° C./40% | 50° C./40% | 50° C./40% | 50° C./40% | 50° C./40% | — | — | 50° C./40% | 50° C./40% |
| Physical Properties of Toner | | | | | | | | | | | |
| Calories (J/g) | 1.8 | 4.3 | 5.0 | 4.2 | 6.2 | 6.6 | 1.7 | 12.6 | 11.1 | 5.9 | 14.4 |
| Average Circularity | 0.959 | 0.952 | 0.955 | 0.956 | 0.950 | 0.941 | 0.938 | 0.942 | 0.946 | 0.955 | 0.934 |
| BET Specific Area ($m^2$/g) | 1.3 | 1.2 | 1.2 | 1.2 | 1.1 | 0.8 | 1.6 | 2.7 | 2.6 | 2.8 | 2.7 |
| Content of Particles of Less Than 3 μm (% by Number) | 2.9 | 3.0 | 3.8 | 3.6 | 3.5 | 3.2 | 3.6 | 3.9 | 3.5 | 11.0 | 4.1 |
| Tg (° C.) | 51 | 51 | 55 | 51 | 53 | 56 | 59 | 41 | 32 | 56 | 54 |
| Evaluations of Toner | | | | | | | | | | | |
| Lowest Fixing Temp. (° C.) | 120 | 115 | 110 | 110 | 115 | 115 | 130 | 115 | 120 | 120 | 115 |
| Transfer Efficiency (%) | 85 | 82 | 79 | 78 | 69 | 68 | 41 | 52 | 55 | 70 | 79 |
| Image Density | 1.8 | 1.8 | 1.8 | 1.6 | 1.5 | 1.4 | 1.2 | 1.3 | 1.3 | 1.6 | 1.7 |
| Durability | ◎ | ○ | ○ | Δ | Δ | Δ | ○ | X | X | X | X |
| (Amount of Toner Spent) | (0.02) | (0.03) | (0.03) | (0.15) | (0.18) | (0.20) | (0.10) | (0.35) | (0.33) | (0.32) | (0.31) |
| Storage Property | ○ | ○ | ○ | ○ | ○ | ○ | ○ | X | X | ○ | ○ |

It can be seen from the above results that, the toners of Examples 2-1 to 2-6 are excellent in both low-temperature fixing ability and storage property, and excellent transfer efficiency is maintained even in durability printing at a low printing ratio, as compared to the toners of Comparative Examples 2-1 to 2-5.

The toner for electrophotography obtained according to the present invention is suitably used for, for example, developing a latent image formed in electrophotography, electrostatic recording method, electrostatic printing method, or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A process for preparing a toner for electrophotography comprising mother toner particles which comprise a resin binder comprising a crystalline polyester and a linear amorphous polyester and an external additive, wherein the process comprises an external addition step of mixing the mother toner particles and at least a part of the external additive and the step of carrying out a heat-treating step at the external addition step or later.

2. The process according to claim 1, wherein the crystalline polyester is contained in an amount of from 2 to 35% by weight of the resin binder.

3. The process according to claim 1, wherein silica A having an average particle size of from 12 to 120 nm is at least used as the external additive used in the external addition step before the heat-treating step.

4. The process according to claim 3, wherein silica B having an average particle size smaller than that of the silica A is further used as the external additive used in the external addition step before the heat-treating step.

5. The process according to claim 1, wherein the heat-treating step is carried out under the conditions at a heating temperature t (° C.) satisfying, $$Tg_1 \leqq t \leqq Tm-10$$

wherein $Tg_1$ is a glass transition temperature (° C.) of a product to be subjected to the heat-treating step; and Tm is a softening point (° C.) of a product to be subjected to the heat-treating step.

6. The process according to claim 5, wherein the time of heat treatment is from 2 to 36 hours.

7. The process according to claim 6, the relative humidity during the heat-treating step is from 10 to 70%.

8. The process according to claim 6, the relative humidity during the heat-treating step is from 20 to 60%.

9. The process according to claim 5, wherein the time of heat treatment is from 5 to 30 hours.

10. The process according to claim 5, wherein $Tg_1+10 \leqq t \leqq Tm-20$.

11. The process according to claim 5, wherein $Tg_1+15 \leqq t \leqq Tm-30$.

12. A toner for electrophotography obtained by the process as defined in claim 1.

13. A method of forming fixed images, comprising the step of applying the toner as defined in claim 12 to an image-forming apparatus having a linear speed of 750 mm/sec or more.

14. The process according to claim 1, wherein the time of heat treatment is from 2 to 36 hours.

15. The process according to claim 1, wherein the time of heat treatment is from 5 to 30 hours.

16. The process according to claim 1, wherein the average circularity of the toner particles after the heat-treating step is from 0.930 to 0.980.

17. The process according to claim 1, wherein the average circularity of the toner particles after the heat-treating step is from 0.940 to 0.970.

18. The process according to claim 1, wherein the alcohol component of the crystalline polyester comprises an aliphatic diol having 2 to 8 carbon atoms in an amount of 90% by mol or more of the alcohol component.

19. The process according to claim 1, wherein the alcohol component of the linear amorphous polyester comprises an alkylene oxide adduct of bisphenol A represented by the formula (I):

(I)

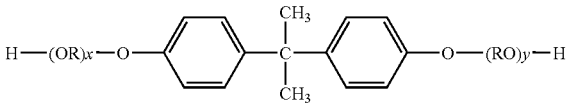

wherein RO is an alkyleneoxy group; R is an alkylene group having 2 or 3 carbon atoms; x and y are positive numbers showing an average number of moles of alkylene oxide added, wherein a sum of x and y is from 1 to 16, in an amount of from 90 to 100% by mol of the alcohol component.

20. The process according to claim 1, wherein the carboxylic acid component of the linear amorphous polyester comprises an aliphatic dicarboxylic acid compound in an amount of from 90 to 100% by mol of the carboxylic acid component.

* * * * *